US008887370B2

(12) United States Patent
Payne et al.

(10) Patent No.: US 8,887,370 B2
(45) Date of Patent: Nov. 18, 2014

(54) RACKABLE FENCE SYSTEM

(71) Applicant: Betafence USA LLC, Ennis, TX (US)

(72) Inventors: John F. Payne, Ennis, TX (US); Robert W. Newman, Ennis, TX (US); Donald G. Keilers, Ennis, TX (US)

(73) Assignee: Betafence USA LLC, Ennis, TX (US)

( * ) Notice: Subject to any disclaimer, the term of this patent is extended or adjusted under 35 U.S.C. 154(b) by 0 days.

(21) Appl. No.: 13/850,140

(22) Filed: Mar. 25, 2013

(65) Prior Publication Data

US 2013/0292621 A1 Nov. 7, 2013

Related U.S. Application Data

(63) Continuation of application No. 12/344,457, filed on Dec. 26, 2008, now Pat. No. 8,403,303.

(60) Provisional application No. 61/139,537, filed on Dec. 19, 2008.

(51) Int. Cl.

| | |
|---|---|
| ***B21D 39/06*** | (2006.01) |
| ***E04H 17/14*** | (2006.01) |
| ***E04H 17/26*** | (2006.01) |

(52) U.S. Cl.

CPC ..... *E04H 17/1443* (2013.01); *E04H 17/1439* (2013.01); *E04H 17/26* (2013.01)

USPC ..... 29/505

(58) Field of Classification Search

USPC ..... 29/505; 256/21, 22, 59, 65.09, 65.11, 256/65.12, 67

See application file for complete search history.

(56) References Cited

U.S. PATENT DOCUMENTS 2,614,827 A * 10/1952 Peach et al. ..... 29/509
3,357,681 A * 12/1967 Souza, Jr ..... 256/65.11

(Continued)

FOREIGN PATENT DOCUMENTS

| | | | |
|---|---|---|---|
| EP | 0 634 536 AI | 1/1995 | ..... E04F 11/18 |
| GB | 2 070 664 A | 9/1981 | ..... E04H 17/14 |
| WO | WO 2005/059279 A1 | 6/2005 | ..... E04H 17/14 |

OTHER PUBLICATIONS

PCT Notification of Transmittal of the International Search Report and the Written Opinion of the International Searching Authority, or the Declaration mailed Jun. 2, 2010 with regard to PCT/US2009/068526 filed Jan. 17, 2009 (14 pgs).

(Continued)

*Primary Examiner* — Michael P Ferguson
(74) *Attorney, Agent, or Firm* — Baker Botts L.L.P.

(57) ABSTRACT

In certain embodiments, a fence system includes a rail having a first surface having one or more apertures. The rail also includes second and third surfaces opposing one another, the first, second, and third surfaces of the rail forming a channel. The second surface and the third surface of the rail have first and second lips, respectively, the first and second lips extending into the channel. The fence system section also includes one or more pickets inserted through corresponding apertures of the first surface of the rail. Each picket has a first connection region located substantially in the channel formed by the first, second, and third surfaces of the rail such that the first connection region is substantially prevented from passing through the corresponding aperture in the first surface of the rail or between the opening defined by the first and second lips of the rail.

12 Claims, 19 Drawing Sheets

(56) References Cited

U.S. PATENT DOCUMENTS

| | | | | | |
|---|---|---|---|---|---|
| 3,955,799 | A | * | 5/1976 | Lauzier | 256/65.11 |
| 4,027,855 | A | * | 6/1977 | Lauzier | 256/65.11 |
| 4,508,321 | A | * | 4/1985 | Morimoto | 29/523 |
| 5,136,813 | A | | 8/1992 | Gibbs et al. | |
| 5,150,885 | A | * | 9/1992 | Leone | 256/22 |
| 5,167,049 | A | | 12/1992 | Gibbs | |
| 5,272,838 | A | | 12/1993 | Gibbs | |
| 5,345,723 | A | | 9/1994 | Gibbs | |
| 5,443,244 | A | | 8/1995 | Gibbs | |
| 5,597,196 | A | | 1/1997 | Gibbs | |
| 6,088,902 | A | * | 7/2000 | Summers | 29/523 |
| 6,176,043 | B1 | | 1/2001 | Gibbs | |
| 6,254,064 | B1 | | 7/2001 | Gibbs | |
| 6,811,145 | B2 | | 11/2004 | Gibbs et al. | |
| 6,874,767 | B1 | | 4/2005 | Gibbs | |
| 6,969,051 | B1 | | 11/2005 | Gibbs | |
| 7,071,439 | B2 | | 7/2006 | Gibbs et al. | |
| 7,159,853 | B2 | | 1/2007 | Gibbs et al. | |
| 7,188,826 | B1 | | 3/2007 | Gibbs | |
| 7,282,659 | B1 | | 10/2007 | Gibbs et al. | |
| 7,325,787 | B1 | | 2/2008 | Gibbs | |
| D566,292 | S | | 4/2008 | Gibbs | |
| D572,374 | S | | 7/2008 | Gibbs | |
| D573,270 | S | | 7/2008 | Gibbs | |
| 7,396,002 | B1 | | 7/2008 | Gibbs | |
| 7,441,751 | B1 | | 10/2008 | Gibbs | |
| 7,461,833 | B1 | | 12/2008 | Gibbs | |
| 7,475,868 | B1 | | 1/2009 | Gibbs | |
| 7,503,551 | B2 | | 3/2009 | Auret | |
| 8,403,303 | B2 | | 3/2013 | Payne et al. | |
| 2003/0209700 | A1 | | 11/2003 | Gibbs | |
| 2005/0023514 | A1 | | 2/2005 | Gibbs et al. | |
| 2005/0023515 | A1 | | 2/2005 | Gibbs et al. | |
| 2005/0040382 | A1 | | 2/2005 | Gibbs et al. | |
| 2005/0092978 | A1 | | 5/2005 | Gibbs et al. | |
| 2005/0199864 | A1 | | 9/2005 | Gibbs et al. | |
| 2005/0205854 | A1 | | 9/2005 | Gibbs et al. | |
| 2006/0226407 | A1 | * | 10/2006 | Auret | 256/22 |
| 2010/0155683 | A1 | | 6/2010 | Payne et al. | |

OTHER PUBLICATIONS

Online Brochure, Versai Fence—Iron Fencing—Rackable Fence—Metal Fencing—Ornamental Fence Supply, LLC, retrieved from http://www.ornamentalfencesupply.com/versai-fence.htm, 4 pgs, Apr. 21, 2009.

Online Brochure, Classic Fence—Fence Supplies—Ornamental Iron—Galvanized Fence—Ornamental Fence Supply, LLC, retrieved from http://www.ornamentalfencesupply.com/classif-fence.htm, 3 pages, Apr. 21, 2009.

Brochure, Ornamental Steel, Ornamental Welded, High Security Steel, Anti-Crash Barrier System, Ornamental Aluminum, Color Framework, Galvanized Framework, Gates, Ameristar Fence Products, 32 31 00/AME, Buyline 5862, 44 pages, Apr. 21, 2009.

Brochure, Echelon []™ Industrial Ornamental Aluminum Fence and Gates, The Higher Level, Maintenance-Free Polyester Finish Over High Strength Aluminum, Ameristar® , retrieved from www.ameristarfence.com, 12 pages, Apr. 21, 2009.

Brochure, Montage® by Ameristar® 7' & 8' Tall Montage Plus® for Greater Perimeter Security, the New Alternative to Chain Link Fencing, retrieved from www.Montagefence.com, 8 pages, Apr. 21, 2009.

Brochure, Ameristar®, World's Largest Ornamental Fence Manufacturer, Made in America, Montage® Ornamental Welded Steel Fence Makes the Grade, retrieved from www.MontageFence.com, 20 pages, Apr. 21, 2009.

Payne et al., U.S. Appl. No. 12/344,457, Requirement for Restriction Election, May 24, 2011.

Payne et al., U.S. Appl. No. 12/344,457, Amendment, Jun. 24, 2011.

Payne et al., U.S. Appl. No. 12/344,457, Non-final Rejection Applicant Arguments made in an Amendment, Aug. 19, 2011.

Payne et al., U.S. Appl. No. 12/344,457, Non-final Rejection, Sep. 20, 2011.

Payne et al., U.S. Appl. No. 12/344,457, Applicant Initiated Interview, Dec. 19, 2011.

Payne et al., U.S. Appl. No. 12/344,457, Amendment to Non-final Rejection, Dec. 20, 2011.

Payne et al., U.S. Appl. No. 12/344,457, Final Rejection, Feb. 6, 2012.

Payne et al., U.S. Appl. No. 12/344,457, Applicant Initiated Interview, Apr. 11, 2012.

Payne et al., U.S. Appl. No. 12/344,457, RCE and Amendment, May 7, 2012.

Payne et al., U.S. Appl. No. 12/344,457, Non-final Rejection, Jul. 18, 2012.

Payne et al., U.S. Appl. No. 12/344,457, Amendment to Non-final Rejection, Oct. 18, 2012.

Payne et al., U.S. Appl. No. 12/344,457, Applicant Initiated Interview, Oct. 23, 2012.

Payne et al., U.S. Appl. No. 12/344,457, Applicant Interview Summary, Nov. 19, 2012.

Payne et al., U.S. Appl. No. 12/344,457, Notice of Allowance, Nov. 20, 2012.

Payne et al., U.S. Appl. No. 12/344,457, Issue Notification, Mar. 6, 2013.

* cited by examiner

RACKABLE FENCE SYSTEM

RELATED APPLICATIONS

This application is a continuation of U.S. application Ser. No. 12/344,457, filed Dec. 26, 2008, entitled "Rackable Fence System," now U.S. Pat. No. 8,403,303, which claims the benefit under 35 U.S.C. §119(e) of the priority of U.S. Provisional Application No. 61/139,537, filed Dec. 19, 2008, entitled "Rackable Fence System."

TECHNICAL FIELD

This invention relates generally to fence systems and more particularly to a rackable fence system.

BACKGROUND

Fences are free standing structures designed to restrict and/or prevent movement across a boundary. One type of fence often used for domestic boundaries due to its aesthetic qualities is the picket fence. In general, picket fences include at least two rails spanning across a number of posts anchored in the ground. Picket fences also include a number of pickets, usually evenly-spaced, extending across the rails and oriented generally parallel to the posts.

SUMMARY

According to embodiments of the present invention, disadvantages and problems associated with previous rackable fence systems may be reduced or eliminated.

In certain embodiments, a fence system includes a rail having a first surface having one or more apertures. The rail also includes second and third surfaces opposing one another, the first, second, and third surfaces of the rail forming a channel. The second surface and the third surface of the rail have first and second lips, respectively, the first and second lips extending into the channel. The fence system section also includes one or more pickets inserted through corresponding apertures of the first surface of the rail. Each picket has a first connection region located substantially in the channel formed by the first, second, and third surfaces of the rail such that the first connection region is substantially prevented from passing through the corresponding aperture in the first surface of the rail or between the opening defined by the first and second lips of the rail.

In certain embodiments, a method of assembling a fence system section includes inserting a first picket through a first aperture of a first surface of a first rail, the first rail including a second surface and a third surface opposing one another such that the first, second, and third surfaces of the first rail form a channel, the second surface of the first rail having a first lip and the third surface of the first rail having a second lip, the first lip and the second lips extending into the channel formed by the first, second, and third surfaces of the first rail. The method also includes creating a first connection region on the first picket, the first connection region of the first picket located substantially in the channel formed by the first, second, and third surfaces of the first rail such that the first connection region of the first picket is substantially prevented from passing through the aperture in the first surface of the first rail or between the opening defined by the first and second lips of the first rail.

Particular embodiments of the present invention may provide one or more technical advantages. One technique for installing a picket-style fence is to construct and install the fence on site by setting a number of posts, spanning the distance between the posts by attaching two or more rails, and individually installing a number or pickets across the two or more rails. Installing the fencing on-site in this manner may be time consuming and, as a result, quite costly. An alternative to constructing and installing the fencing on-site is to manufacture fence sections including two or more rails and a number of pickets. Each fence section can then be installed between or across two posts on site. Manufacturing the fence in sections may reduce the time and effort required to install the fence and, as a result, reduce cost.

Because fencing is often installed on sloping ground, it is beneficial to manufacture fencing sections that are "rackable," meaning that the pickets of the fence section remain parallel to the posts between which the two or more rails are installed. Often, manufacturing fence system sections that are rackable increases the complexity as well as the cost of the fence system section. Certain embodiments of the present invention provide a fence system section that is rackable, while minimizing the complexity and cost associated with manufacturing the fence system section.

Certain embodiments of the present invention may include some, all, or none of the above advantages. One or more other technical advantages may be readily apparent to those skilled in the art from the figures, descriptions, and claims included herein.

BRIEF DESCRIPTION OF THE DRAWINGS

To provide a more complete understanding of the present invention and the features and advantages thereof, reference is made to the following description taken in conjunction with the accompanying drawings, in which.

DESCRIPTION OF EXAMPLE EMBODIMENTS

Figure 1:
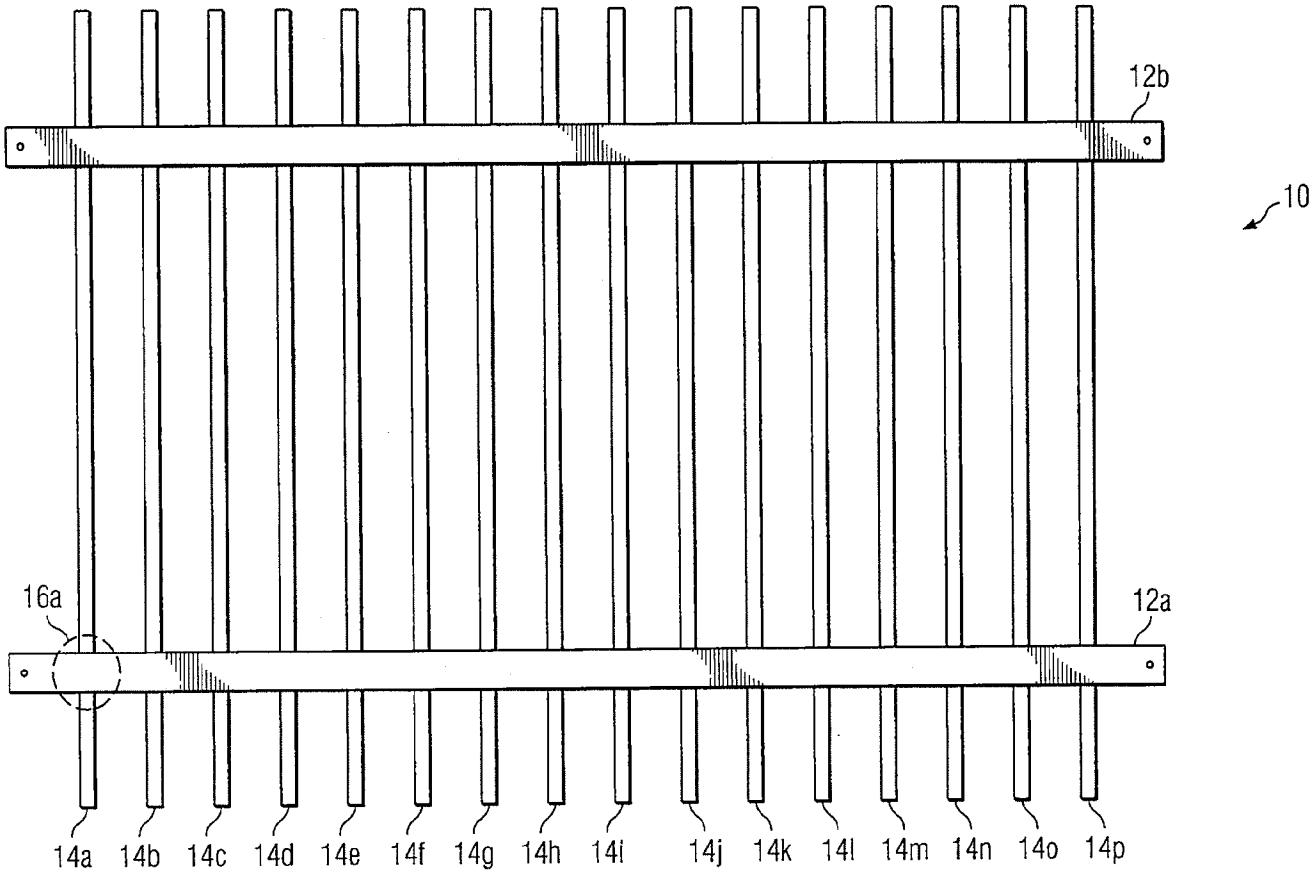
FIG. 1 illustrates an example fence system section, according to certain embodiments of the present invention.

FIG. 1 illustrates an example fence system section 10, according to certain embodiments of the present invention. Fence system section 10 may include one or more rails 12 and one or more pickets 14. Rails 12 and pickets 14 may be of any suitable length, according to particular needs. For example, fence system section 10 may include two equal length rails 12*a* and 12*b* oriented substantially parallel to one another. Fence system section 10 may also include a number of pickets 14*a*-14*r* oriented substantially parallel to one another. In certain embodiments, pickets 14*a*-14*r* are substantially evenly-spaced and equal in length. Although a particular number of rails 12 and pickets 14 are illustrated and primarily described, the present invention contemplates any suitable number of rails 12 and pickets 14.

Fence system section 10 may also include a number of first rail-picket connections 16 at each intersection of a rail 12 and a picket 14 (e.g., first rail-picket connection 16*a*), described in more detail below with respect to FIGS. 2A-2C. Each picket 14 of fence system section 10 may be inserted through corresponding apertures in each of rails 12*a* and 12*b* at rail-picket connection 16.

In certain embodiments, fence system section 10 may be rackable. In other words, rail 12*a* and rail 12*b* may remain substantially parallel when translating with respect to one another. Furthermore, as rail 12*a* and rail 12*b* are translated with respect to one another (i.e., moved in opposite directions while remaining substantially parallel), pickets 14*a*-14*r* remain substantially parallel. Features of rail-picket connections 16 allow fence system section 10 to be rackable.

Figure 2A:
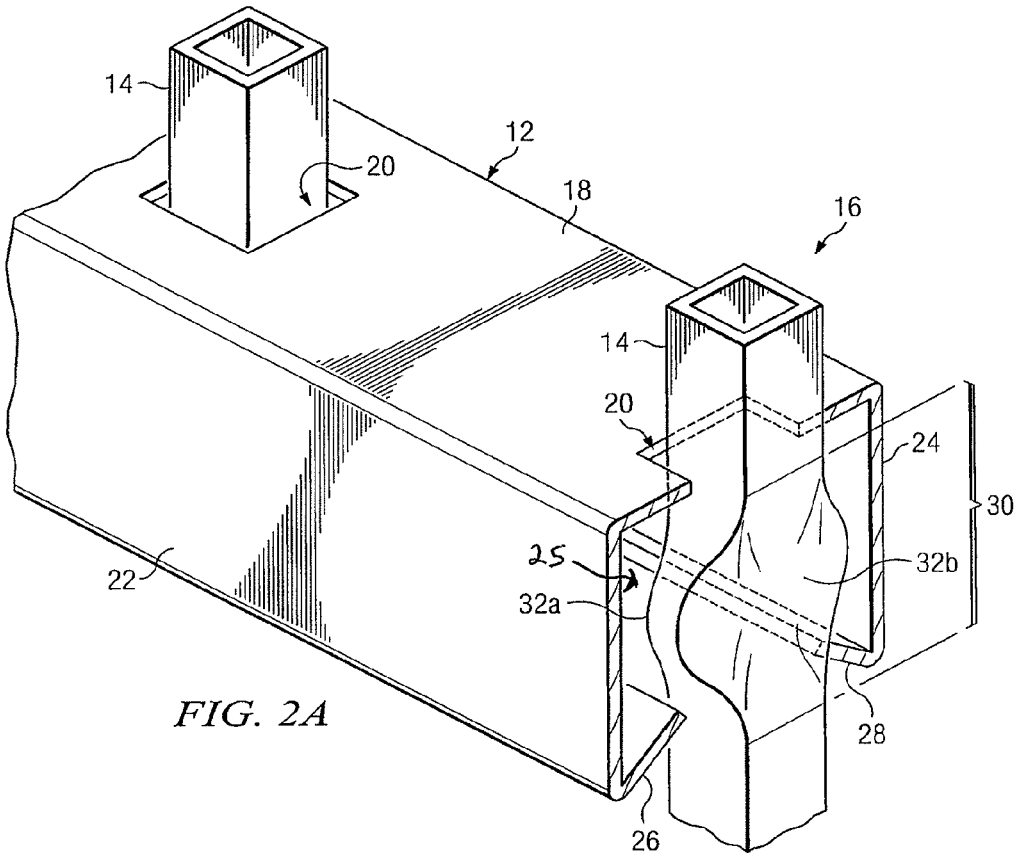
FIGS. 2A-2D illustrate a first example rail-picket connection, according to certain embodiments of the present invention.
Figure 2B:
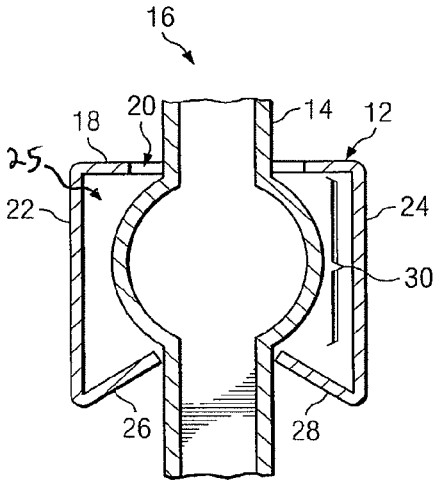
Figure 2C:
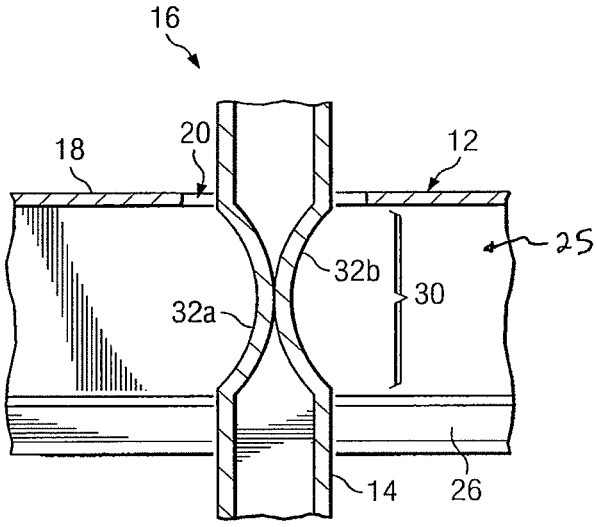
Figure 2D:
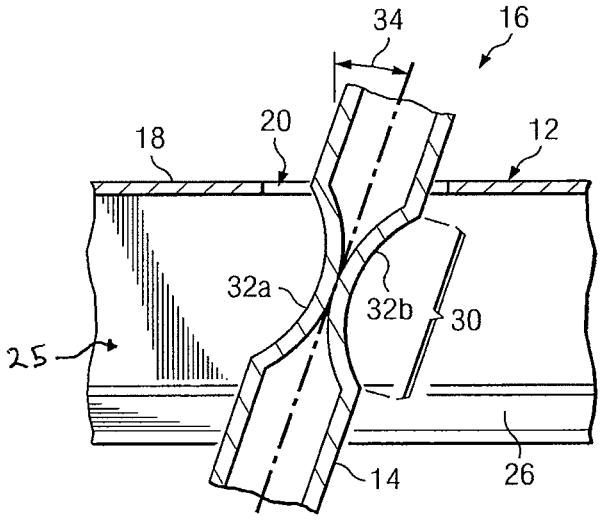

FIGS. 2A-2D illustrate a first example rail-picket connection 16, according to certain embodiments of the present invention. In particular, FIG. 2A illustrates a three-dimensional cross-sectional view of first rail-picket connection 16, FIG. 2B illustrates a two-dimensional cross-sectional view (i.e., which for simplicity may be thought of as a "side" view) of first rail-picket connection 16, and FIGS. 2C-2D illustrate two-dimensional, cross-sectional views (i.e., which for simplicity may be thought of as a "front" or "back" view) of first rail-picket connection 16.

Rail 12 of rail-picket connection 16 may have a first surface 18 having an aperture 20. Rail 12 may also have a second surface 22 and a third surface 24. First surface 18, second surface 22, and third surface 24 are oriented such that they form a channel 25. Second surface 22 of rail 12 may include a first lip 26 extending into channel 25 formed by first surface 18, second surface 22, and third surface 24. Similarly, third surface 24 of rail 12 may include a second lip 28 extending into channel 25 formed by first surface 18, second surface 22, and third surface 24.

Rail 12 may be constructed (e.g., by roll forming) from aluminum, iron, stainless steel, galvanized steel, brass, plastic (as described in further detail below with respect to third rail-picket connection 68 illustrated in FIG. 8), or any other suitable material. As a particular example, rail 12 may be a galvanized steel Unistrut® channel. Aperture 20 may be one of a plurality of apertures in first surface 18 of rail 12. Aperture 20 in first surface 18 may be round, rectangular, or any other suitable shape. For example, the shape of aperture 20 in first surface 18 may correspond to the cross-sectional shape of picket 14 (e.g., aperture 20 in first face 16 would be rectangular if picket 14 were constructed of a length of rectangular tubing). Additionally, the size of aperture 20 may be sufficiently large to allow a portion of picket 14 to be inserted through aperture 20.

Picket 14 may be constructed from aluminum, iron, stainless steel, galvanized steel, brass, plastic (as described in further detail below with respect to third rail-picket connection 68 illustrated in FIG. 8), or any other suitable material. Furthermore, picket 14 may be constructed from tubing material of any desired cross section (e.g., rectangular, round, elliptical), solid material of any desired cross section (e.g., rectangular, round, elliptical), angle iron, I-beam, or any other suitable material. As a particular example, picket 14 of first rail-picket connection 16 may be constructed from a length of galvanized steel rectangular tubing.

Picket 14 of rail-picket connection 16 may be inserted through aperture 20 of rail 12 and through the opening defined by first lip 26 and second lip 28. In certain embodiments, picket 14 may include a connection region 30. Connection region 30 of picket 14 includes a portion of picket 14 that has been crushed or otherwise deformed. In certain embodiments, connection region 30 may include a portion of picket 14 where two opposing surfaces 32*a* and 32*b* have been pushed together (e.g., by applying a crushing force and/or heat to picket 14, as described in further below detail with respect to FIGS. 9A-9C), resulting in a widening of picket 14 in the cross-sectional direction (illustrated in FIG. 2B) and a narrowing of picket 14 in the longitudinal-section direction (illustrated in FIG. 2C). In certain other embodiments, connection region 30 of picket 14 may be a portion of picket 14 to which material has been added, resulting in a widening of the picket (as described in further detail below with respect to FIGS. 12-15).

At least a portion of connection region 30 of picket 14 may be located on a portion of picket 14 located between aperture 20 and the opening defined by first lip 26 and second lip 28 of rail 12 (e.g., in channel 25). Additionally, the increased width of a portion of picket 14 in connection region 30 may substantially prevent first connection region 30 from passing through aperture 20 or between the opening defined by first lip 26 and second lip 28, thereby substantially preventing picket 14 from disengaging with rail 12 by sliding through aperture 20 or the opening defined by first lip 26 and second lip 28 of rail 12. As a result, first connection region 30 may form a connection (i.e., rail-picket connection 16) between rail 12 and picket 14, although picket 14 may not be physically joined (e.g., welded) to rail 12.

Although particular types of rail-picket connections are illustrated and described, the present invention contemplates any suitable type of rail picket connection that includes a connection region (e.g., connection region 30) that interacts with features (e.g., surface 18 and lips 26 and 28 of surfaces 22 and 24) of a rail (e.g., rail 12) to substantially prevent the picket (e.g., picket 14) from disengaging with the rail (e.g., rail 12) without physically joining the picket to the rail (e.g., by welding the picket to the rail).

Rail-picket connection 16 may substantially prevent translational movement of picket 14 with respect to rail 12. For example, the width of connection region 30 (as illustrated in FIG. 2A) may be greater than the width of aperture 20 (as described above) such that connection region 30 is substantially prevented from passing through aperture 20. Furthermore, the width of connection region 30 (as illustrated in FIG. 2B) may be greater than the width of the opening defined by first lip 26 and second lip 28 (as described above) such that connection region 30 is substantially prevented from passing through the opening defined by first lip 26 and second lip 28. Because connection region 30 is substantially prevented from passing through aperture 20, or between the opening defined by first lip 26 and second lip 28, picket 14 is substantially prevented from translating vertically (e.g., up or down) with respect to rail 12. Additionally, the walls of aperture 20, first lip 26, and second lip 28 substantially prevent picket 14 from translating horizontally (e.g., left, right, forward, or backward) with respect to rail 12. In other words, rail-picket connection 16 may substantially prevent translational movement of picket 14 relative to rail 12.

Rail-picket connection 16 may allow for angular, or rotational, movement of picket 14 with respect to rail 12. For example, rail-picket connection 16 may allow angular movement 34 of picket 14 along a longitudinal axis of rail 12 (movement parallel to the opening defined by first lip 26 and second lip 28 of rail 12), as illustrated in FIG. 2D. The amount of angular movement 34 along the longitudinal axis of rail 12 may be limited by the width of aperture 20 relative to the width of picket 14. For example, the greater the width of aperture 20 relative to the width of picket 14, the greater angular movement 34 along the longitudinal axis of rail 12 may be allowed. In certain embodiments, rail-picket connection 16 substantially prevents angular movement of picket 14 other than angular movement along the longitudinal axis of rail 12 (e.g., angular movement 34). For example, the opening defined by first lip 26 and second lip 28 may be only slightly greater than the width of picket 14 such that angular movement of picket 14 other than along the longitudinal axis of rail 12 may be substantially prevented.

Figure 3A:
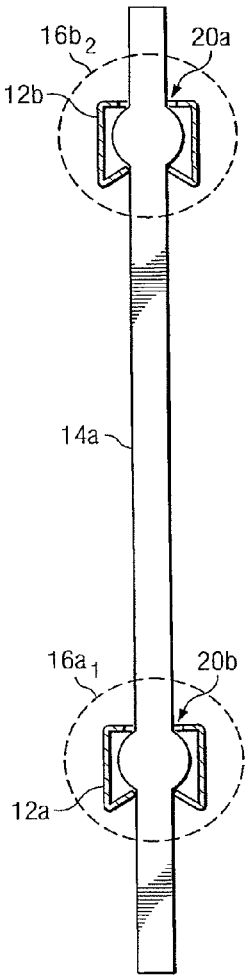
FIGS. 3A-3C illustrate a portion of the fence system section illustrated in FIG. 1 having multiple first example rail-picket connections (i.e., illustrated in FIGS. 2A-2D), according to certain embodiments of the present invention.
Figure 3B:
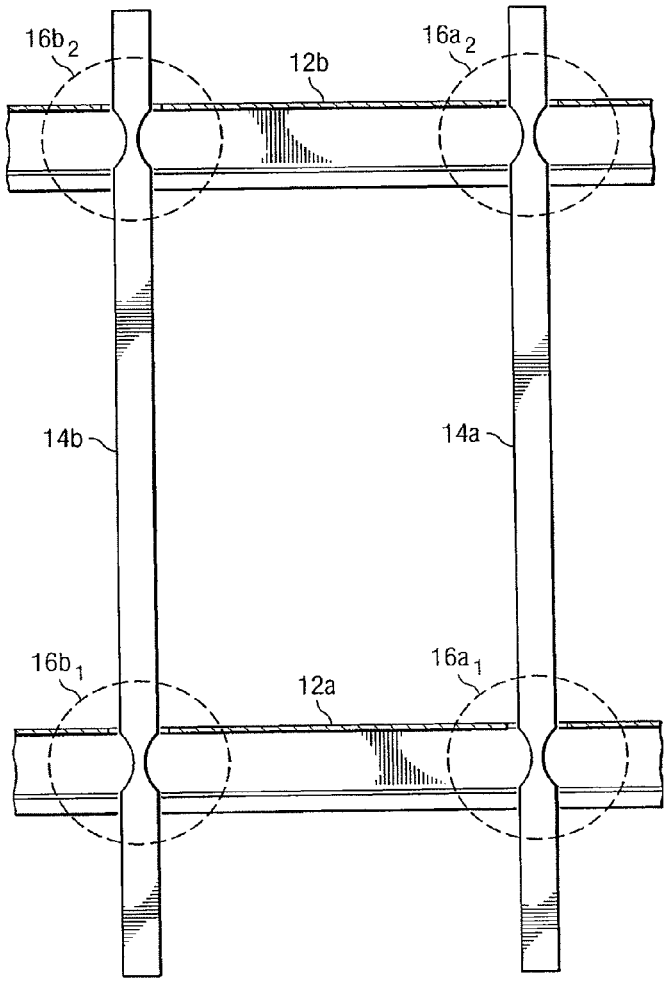
Figure 3C:
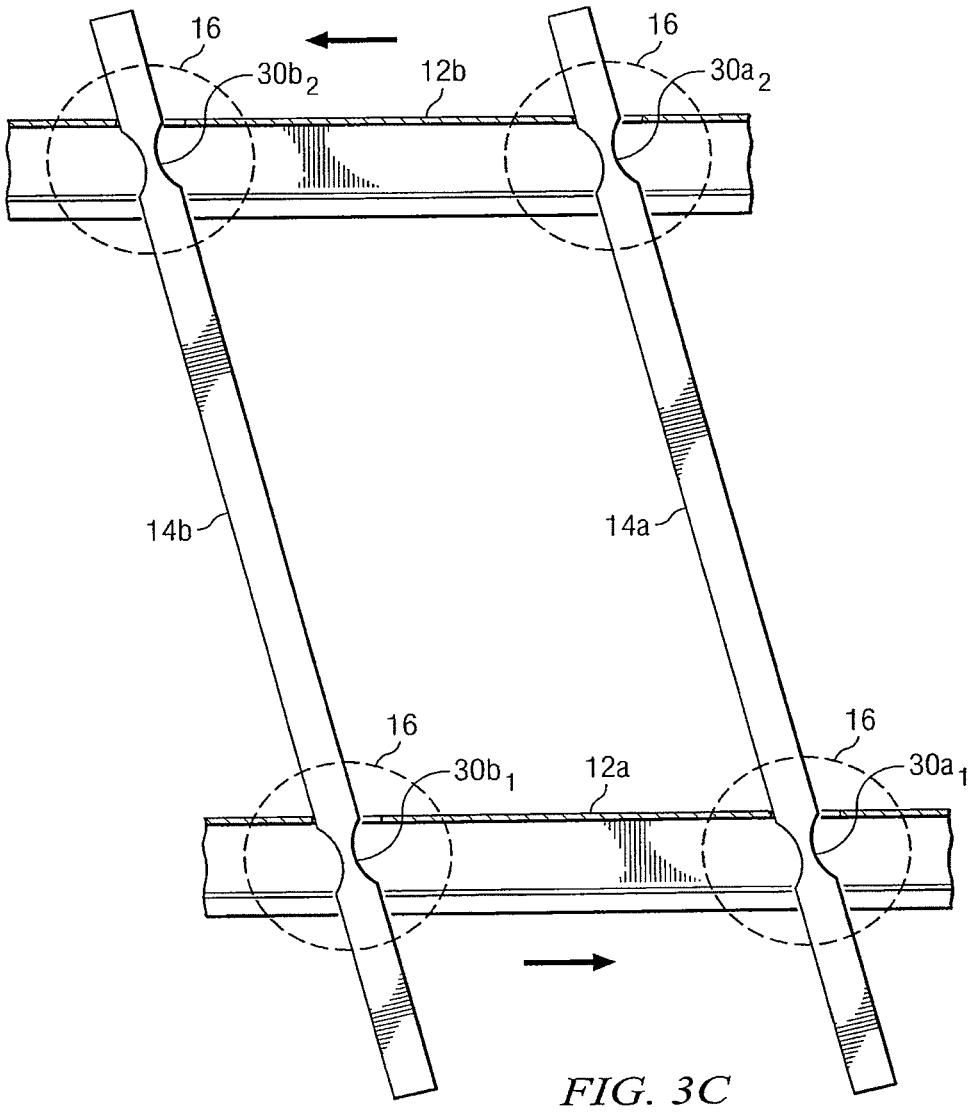

FIGS. 3A-3C illustrate a portion of fence system section 10 illustrated in FIG. 1 having multiple first example rail-picket connections 16 (i.e., illustrated in FIGS. 2A-2D), according to certain embodiments of the present invention. More particularly, FIG. 3A illustrates a cross-sectional view of a portion of fence system section 10, and FIGS. 3B-3C illustrate longitudinal sections of a portion of fence system section 10. The portion fence system section 10 illustrated in FIGS. 3A-3C includes rails 12*a* and 12*b* (oriented substantially parallel to one another) and pickets 14*a* and 14*b* (oriented substantially parallel to one another). Furthermore, rail 12*a* may be connected to picket 14*a* at rail-picket connection $\mathbf{16}a_1$, rail 12*a* may be connected to picket 14*b* at rail-picket connection $\mathbf{16}b_1$, rail 12*b* may be connected to picket 14*a* at rail-picket connection $\mathbf{16}a_2$, and rail 12*b* may be connected to picket 14*b* at rail-picket connection $\mathbf{16}b_2$.

As described above with respect to FIGS. 2A-2D, each rail-picket connection 16 of fence system section 10 may allow angular movement 34 of a picket 14 with respect to a rail 12 along a longitudinal axis of the rail 12. As a result of angular movement 34 allowed at each rail-picket connection 16, rails 12*a* and 12*b* may be able to translate with respect to one another while remaining substantially parallel (e.g., as illustrated in FIG. 3C). Furthermore, as rail 12*a* and rail 12*b* translate with respect to one another while remaining substantially parallel, pickets 14*a* and 14*b* also remain substantially parallel (e.g., as illustrated in FIG. 3C).

Figure 4:
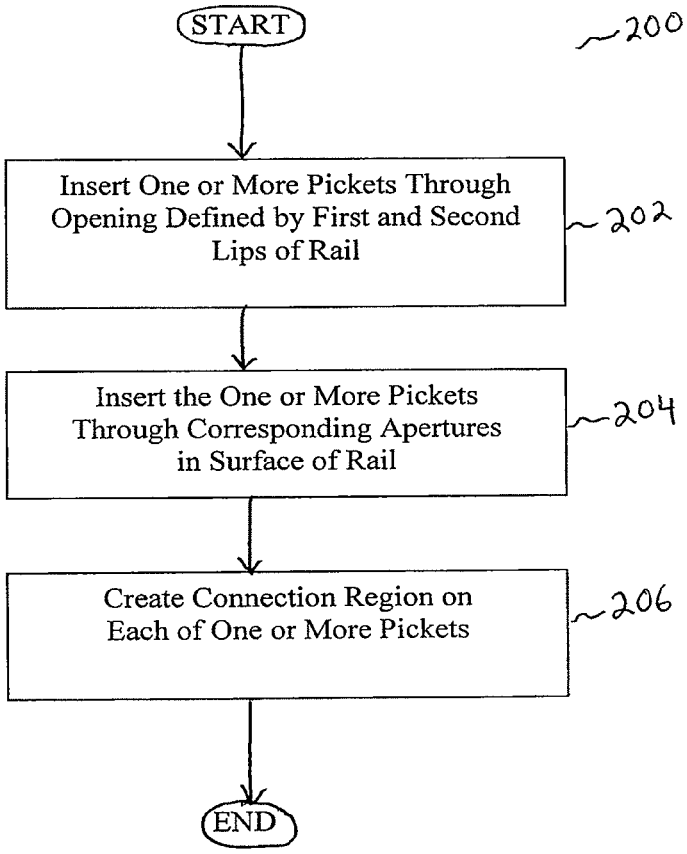
FIG. 4 illustrates an example method for assembling a fence system section having the first example rail-picket connections, according to certain embodiments of the present invention.

FIG. 4 illustrates an example method 200 for assembling fence system section 10 having first example rail-picket connections 16, according to certain embodiments of the present invention. For purposes of this example, it will be assumed that rails 12 that include a number of apertures 20 have already been formed. These rails 12 may be formed in any suitable manner, according to particular needs. In general, apertures 20 are substantially evenly-spaced in rails 12, which may allow pickets 14 to be evenly spaced when connected to a particular rail 12 and to be substantially parallel to at least their adjacent pickets 14 when joined to two parallel rails 12.

At step 202, one or more pickets 14 may be inserted through the opening defined by a first lip 26 and a second lip 28 of a rail 12. At step 204, the one or more pickets 14 may be further inserted through corresponding apertures 20 in first surface 18 of rail 12. Thus, the one or more pickets 14 may extend through rail 12.

In certain embodiments, the surfaces of picket 14 may be painted prior to picket 14 being inserted through the opening defined by first lip 26 and second lip 28 (e.g., at step 202) or through aperture 20 in first face 18 (e.g., at step 204) in order to ensure that the surfaces of picket 14 are fully coated with paint (e.g., the portion of the surfaces of picket 14 located in the channel formed by first surface 18, second surface 22, and third surface 24). To prevent scratching of the painted surfaces of picket 14, one or more protective sleeves may first be inserted into channel 25 (i.e., through aperture 20 and the opening defined by first lip 26 and second lip 28) such that the one or more protective sleeves cover the inside edge of first lip 26, second lip 28, and aperture 20. For example, the protective sleeves may be Mylar sleeves that can be removed once picket 14 has passed through the opening defined by a first lip 26 and a second lip 28 of a rail 12 and aperture 20 of first surface 18 of rail 12.

At step 206, a connection region 30 may be created on each of the one or more pickets 14. In certain embodiments, connection region 30 of picket 14 may be a portion of picket 14 that has been crushed or otherwise deformed by having two opposing faces of picket 14 pushed together (e.g., faces 32*a* and 32*b* illustrated in FIG. 2C) resulting in a widening of picket 14 in one or more selected directions (e.g., as shown in the cross section illustrated in FIG. 2B) and a narrowing of picket 14 in one or more other selected directions (e.g., as shown in the longitudinal section illustrated in FIG. 2C). For example, a deformation component may apply a crushing force to opposing faces of picket 14, an example of which is described below with respect to FIGS. 9A-9C. In certain other embodiments, connection region 30 of picket 14 may be a portion of picket 14 to which material has been added, resulting in a widening of picket 14 (as shown in the cross sections illustrated in FIGS. 12A, 13A, 14A, and 15A).

As described above, at least a portion of connection region 30 of picket 14 may be located on a portion of picket 14 located between aperture 20 and the opening defined by first lip 26 and second lip 28 of rail 12. Additionally, the increased width of a portion of picket 14 in connection region 30 may substantially prevent first connection region 30 from passing through aperture 20 or between the opening defined by first lip 26 and second lip 28, thereby substantially preventing picket 14 from disengaging with rail 12 by sliding through aperture 20 or the opening defined by first lip 26 and second lip 28 of rail 12. As a result, first connection region 30 may form a connection (i.e., rail-picket connection 16) between rail 12 and picket 14, although picket 14 may not be physically joined (e.g., welded) to rail 12.

Rail-picket connection 16 may substantially prevent translational movement of picket 14 with respect to rail 12, as described above with respect to FIGS. 2A-2D. Additionally, rail-picket connection 16 may substantially prevent angular movement of picket 14 with respect to rail 12 (other than angular movement 34 along the longitudinal axis of rail 12) for reasons described above with respect to picket—FIGS. 2A-2D.

Although the particular steps of method 200 have been illustrated and primarily described as being performed in a particular order and in a particular manner, the present invention contemplates that the steps take place in any suitable order and be performed in any suitable manner. For example, in certain embodiments, connection region 30 may be created on picket 14, with picket 14 (including connection region 30) being subsequently inserted through the opening defined by first lip 26 and second lip 28 and aperture 20 of first surface 18 of rail 12. In this scenario, rail 12 may be expanded to widen the opening defined by first lip 26 and second lip 28. Once connection region 30 has been placed in the region located between aperture 20 of first face 18 and the opening defined by first lip 26 and second lip 28 (e.g., in channel 25), rail 12 may be returned to its original form such that connection region 30 may be substantially prevented from passing through aperture 20 or between the opening defined by first lip 26 and second lip 28.

As another example, an expanded portion of connection region 30 may be formed in a selection direction prior to insertion of picket 14 through the opening defined by first lip 26 and second lip 28 and aperture 20 of first surface 18 of rail 12. The expanded portion of connection region may be oriented such that it can pass through the opening defined by first lip 26 and second lip 28 as picket 14 is inserted channel 25 and through aperture 20 of first surface 18 of rail 12. Once the expanded portion of connection region 30 is substantially within channel 25, picket 14 may be rotated approximately 90° such that connection region 30 may be substantially prevented from passing through aperture 20 or between the opening defined by first lip 26 and second lip 28.

Figure 5A:
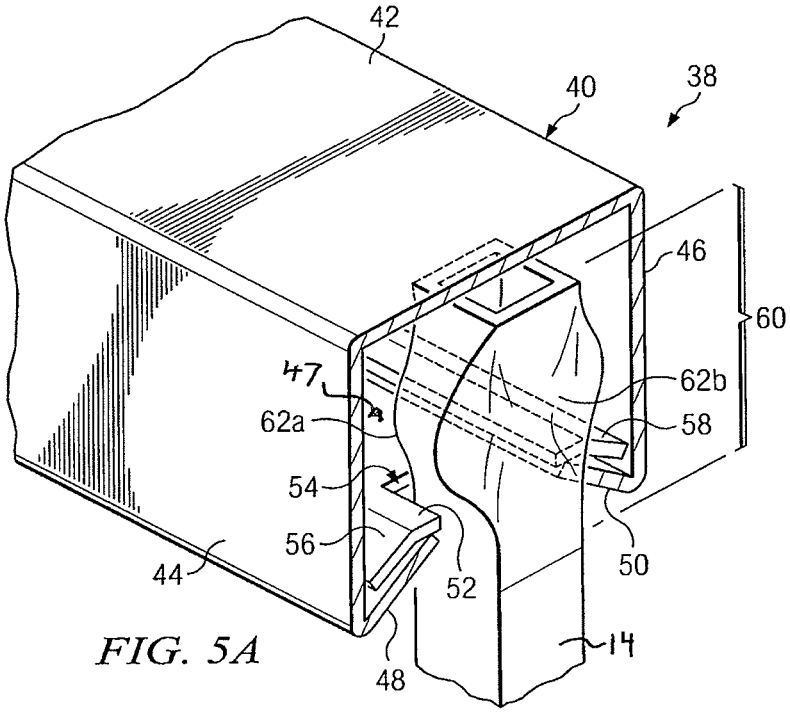
FIGS. 5A-5D illustrate a second example rail-picket connection, according to certain embodiments of the present invention.
Figure 5B:
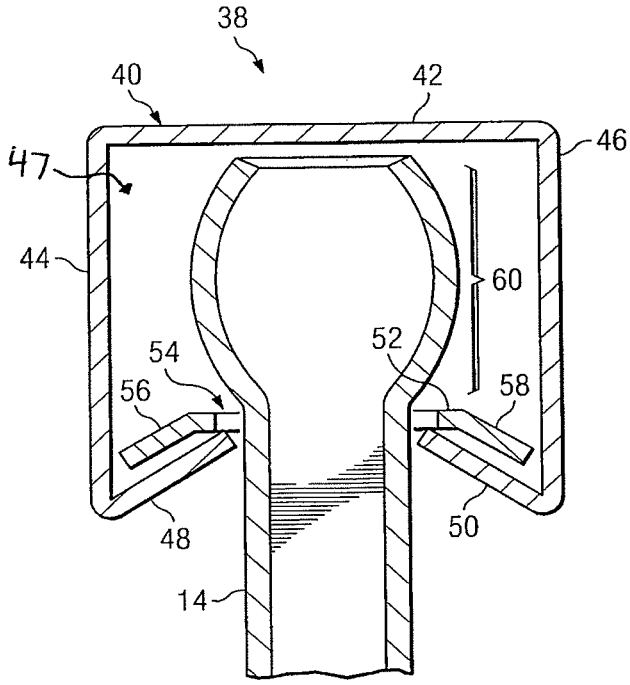
Figure 5C:
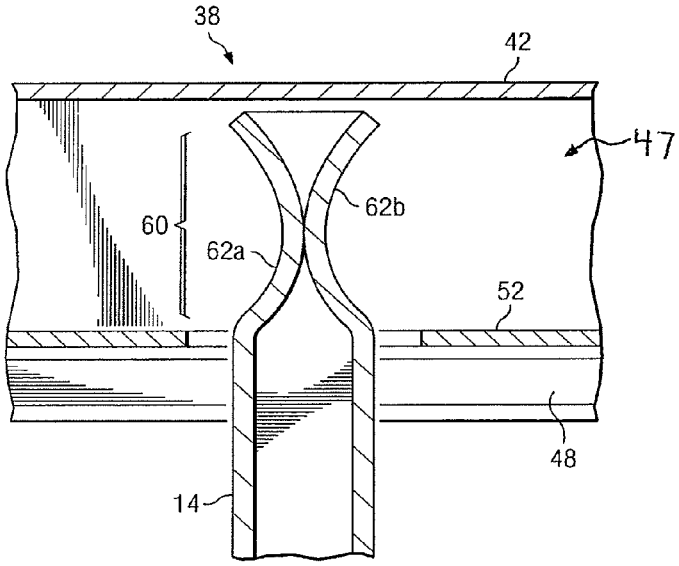
Figure 5D:
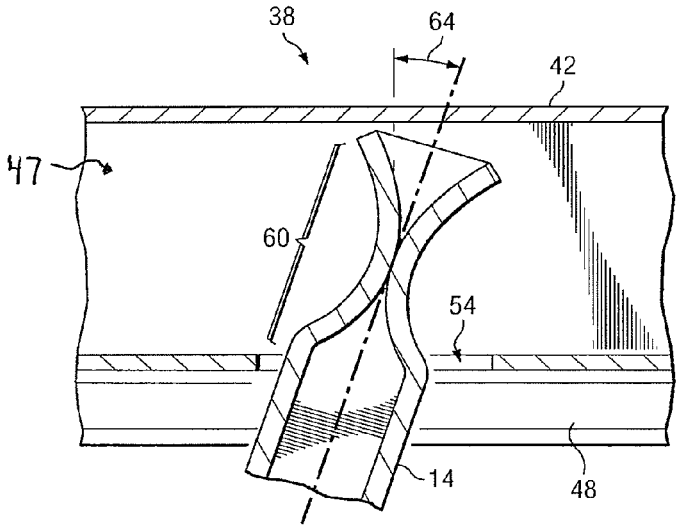

FIGS. 5A-5D illustrate a second example rail-picket connection 38, according to certain embodiments of the present invention. More particularly, FIG. 5A illustrates a three-dimensional, cross-sectional view of rail-picket connection 38, FIG. 5B illustrates a two-dimensional, cross-sectional view of rail-picket connection 38, and FIGS. 5C-5D illustrate longitudinal sections of rail-picket connection 38. In certain embodiments, rail-picket connection 38 may be used in place of one or more first rail-picket connections 16 of fence system section 10 illustrated in FIG. 1. For example, second rail-picket connections 38 may be used to connect a top rail to the pickets.

Rail-picket connection 38 may include a rail 40 and a picket 14. Rail 40 of rail-picket connection 38 may have a first surface 42, a second surface 44, and a third surface 46. First surface 42, second surface 44, and third surface 46 may be oriented such that they form a channel 47. Second surface 44 of rail 40 may include a first lip 48 extending into channel 47 formed by first surface 42, second surface 44, and third surface 46. Similarly, third surface 48 of rail 40 may include a second lip 50 extending into channel 47 formed by first surface 42, second surface 44, and third surface 46. As described above with respect to FIGS. 2A-2D, rail 40 may be constructed (e.g., by roll forming) using any suitable material, according to particular needs.

Rail 40 may include a rail plate 52 located substantially in channel 47 formed by first surface 42, second surface 44, and third surface 46 of rail 40. Rail plate 52 may include rail plate lips 56 and 58. When combined with the remainder of rail 40, rail plate 52 may be oriented inside rail 40 such that rail plate lips 56 and 58 extent downward over corresponding upwardly-extending lips 48 and 50 of rail 40.

Rail plate 52 may have a rail plate aperture 54. Rail plate aperture 54 may be one of a plurality of rail plate apertures in rail plate 52 of rail 40. Rail plate aperture 54 in rail plate 52 may be round, rectangular, or any other suitable shape. For example, the shape of rail plate aperture 54 in rail plate 52 may correspond to the cross-section shape of picket 14 (e.g., rail plate aperture 54 in rail plate 52 would be rectangular if picket 14 were a length of rectangular tubing).

As described above with respect to rail 12 in FIGS. 2A-2D, rail 40 may be constructed (e.g., by roll forming) using any suitable material, according to particular needs. Rail plate 52 may be constructed of the same or a different material as the remainder of rail 40, according to particular needs.

Picket 14 of rail-picket connection 38 may be inserted through the opening defined by first lip 48 and second lip 50 as well as through rail plate aperture 54 of rail plate 52. In certain embodiments, picket 14 may include a second connection region 60. Connection region 60 of picket 14 may be portion of picket 14 that has been crushed or otherwise deformed. In certain embodiments, connection region 60 may be a portion of picket 14 where two opposing surfaces 62*a* and 62*b* have been pushed together (e.g., by applying a crushing force and/or heat to picket 14, as described in further below detail with respect to FIGS. 9A-9C), resulting in a widening of picket 14 in the cross-sectional direction (illustrated in FIG. 5B) and a narrowing of picket 14 in the longitudinal-section direction (illustrated in FIG. 5C). In certain other embodiments, connection region 60 of picket 14 may be a portion of picket 14 to which material has been added, resulting in a widening of the picket (as described in further detail below with respect to FIGS. 12-15).

At least a portion of connection region 60 of picket 14 may be located on a portion of picket 14 located between rail plate aperture 54 of rail plate 52 and the interior of the channel formed by first surface 42, second surface 44, and third surface 48 of rail 40. In addition, rail plate 52 may be wider than the opening defined by first lip 48 and second lip 50 of rail 40. For example, the interaction of lips 56 and 58 of rail plate 52 and lips 48 and 50 of rail 40 may substantially prevent rail plate 52 from passing through the opening formed by lips 48 and 50 of rail 40, securing rail plate 52 in channel 47. Additionally, the increased width of connection region 60 may substantially prevent connection region 60 from passing through rail plate aperture 54, thereby substantially preventing picket 14 from disengaging with rail 12 by sliding through aperture 54 of rail plate 52. As a result, connection region 60 may form a connection (i.e., rail-picket connection 38) between rail 40 and picket 14, although picket 14 may not be physically joined (e.g., welded) to rail 40.

Rail-picket connection 38 may substantially prevent translational movement of picket 14 with respect to rail 40. For example, the width of connection region 60 (as illustrated in FIG. 5B) may be greater than the width of rail plate aperture 54 (as described above) such that connection region 60 is substantially prevented from passing through rail plate aperture 54. Furthermore, the width of rail plate 52 may be greater than the width of the opening defined by first lip 48 and second lip 50 of rail 40 (as described above). Because connection region 60 is substantially prevented from passing through rail plate aperture 54 (as well as between the opening defined by first lip 48 and second lip 50 of rail 40 as rail plate 52 is wider than the opening), picket 14 is substantially prevented from translating vertically (e.g., up or down) with respect to rail 40. Additionally, rail plate aperture 54, first lip 48, and second lip 50 substantially prevent picket 14 from translating horizontally (e.g., left, right, forward, or backward) with respect to rail 40. In other words, rail-picket connection 38 may substantially prevent translational movement of picket 14 relative to rail 40.

Rail-picket connection 38 may allow for angular, or rotational, movement of picket 14 with respect to rail 40. For example, rail-picket connection 38 may allow angular movement 64 of picket 14 along a longitudinal axis of rail 40 (movement parallel to the opening defined by first lip 48 and second lip 50 of rail 40), as illustrated in FIG. 5D. The amount of angular movement 64 along the longitudinal axis of rail 40 may be limited by the width of rail plate aperture 54 relative to the width of picket 14. For example, the greater the width of rail plate aperture 54 relative to the width of picket 14, the greater the angular movement 64 long the longitudinal axis of rail 40 that may be allowed. In certain embodiments, rail-picket connection 38 substantially prevents angular movement of picket 14 other than angular movement along the longitudinal axis of rail 40 (e.g., angular movement 64). For example, the opening defined by first lip 48 and second lip 50 of rail 40. For example, the opening defined by first lip 48 and second lip 50 may be only slightly greater than the width of picket 14 such that all angular movement of picket 14 other than along the longitudinal axis of rail 40 may be substantially prevented.

Figure 6A:
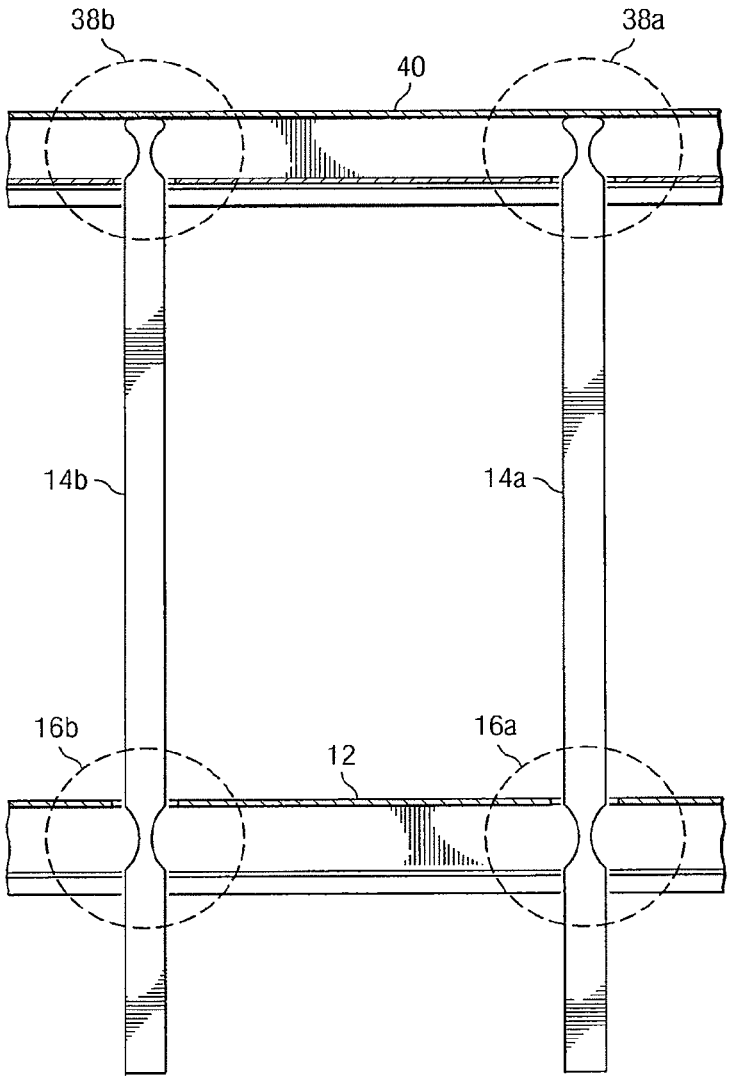
FIGS. 6A-6C illustrate a portion of the example fence system section (i.e., illustrated in FIG. 1) having multiple first example rail-picket connections (i.e., illustrated in FIGS. 2A-2D) and multiple second example rail-picket connections (i.e., illustrated in FIGS. 5A-5D), according to certain embodiments of the present invention.
Figure 6B:
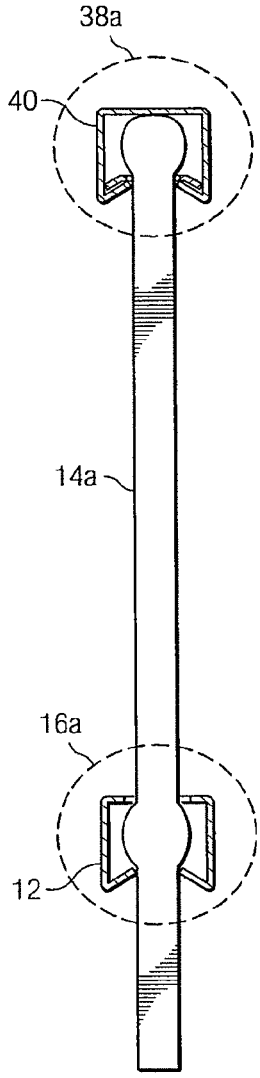
Figure 6C:
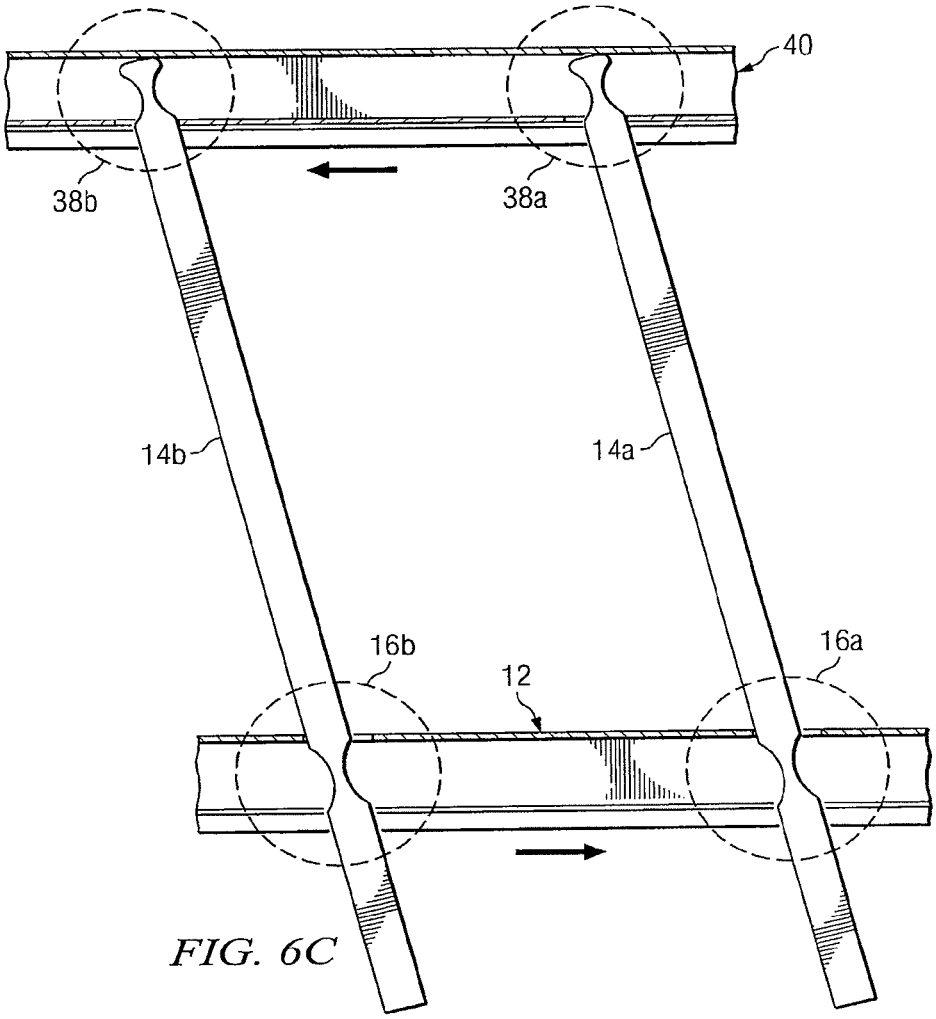

FIGS. 6A-6C illustrate a portion of example fence system section 10 (i.e., illustrated in FIG. 1) having multiple first example rail-picket connections 16 (i.e., illustrated in FIGS. 2A-2D) and multiple second example rail-picket connections 38 (i.e., illustrated in FIGS. 5A-5D), according to certain embodiments of the present invention. More particularly, FIG. 6A illustrates a cross-sectional view of a portion of fence system section 10 and FIGS. 6B-6C illustrate longitudinal sections of a portion of fence system section 10. The portion of fence system section 10 illustrated in FIGS. 6A-6C includes rails 12 and 40 and pickets 14*a* and 14*b*. Furthermore, rail 12 may be connected to picket 14*a* at rail-picket connection 16*a*, rail 12 may be connected to picket 14*b* at rail-picket connection 16*b*, rail 40 may be connected to picket 14*a* at rail-picket connection 38*a*, and rail 40 may be connected to picket 14*b* at rail-picket connection 38*b*.

As described above with respect to FIGS. 2A-2D, each rail-picket connection 16 of fence system section 10 may allow angular movement (e.g., angular movement 34) of each picket 14 with respect to each rail 12 along the longitudinal axis of each rail 12. Furthermore, as described above with respect to FIGS. 5A-5D, each rail-picket connection 38 of fence system section 10 allows angular movement (e.g., angular movement 64) of each picket 14 with respect to each rail 40 along the longitudinal axis of each rail 40. As a result of this angular movement allowed at each rail-picket connection 16 and 38, rails 12 and 40 may be able to translate with respect to one another while remaining substantially parallel (e.g., as illustrated in FIG. 6D). Furthermore, as rail 12 and rail 40 translate with respect to one another while remaining substantially parallel, pickets 14*a* and 14*b* also remain substantially parallel (e.g., as illustrated in FIG. 6D).

Figure 7:
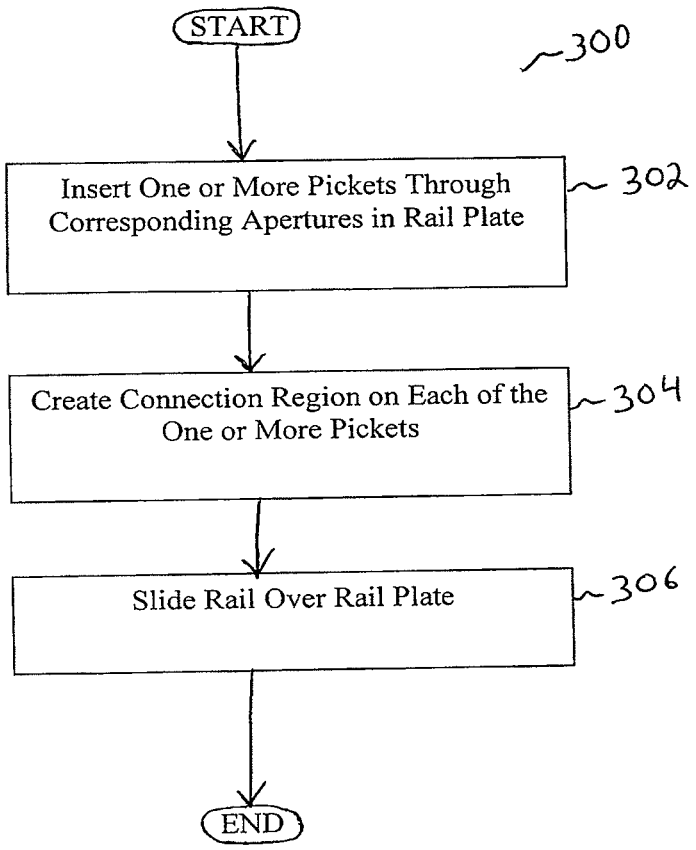
FIG. 7 illustrates an example method for assembling an example fence system section having the second example rail-picket connections, according to certain embodiments of the present invention.

FIG. 7 illustrates an example method 300 for assembling an example fence system section having second example rail-picket connections 38, according to certain embodiments of the present invention. For purposes of this example, it will be assumed that a rail 12 that includes apertures 20 and that a rail 40 that includes rail plate 52 with rail plate apertures 54 have already been formed. These rails 12 and 40 and rail plate 52 may be formed in any suitable manner, according to particular needs. In general, apertures 20 and rail plate apertures 54 are substantially evenly-spaced in rail 12 and rail plate 52, respectively, which may allow pickets 14 to be evenly spaced when connected to a particular rail 12 and to be substantially parallel to at least their adjacent pickets 14 when joined to two parallel rails 12 and 40.

At step 302, one or more pickets 14 may be inserted through corresponding apertures 54 in rail plate 52 of rail 40. In certain embodiments, at step 302 rail plate 52 is located external to the channel formed by first surface 42, second surface 44, and third surface 46 of rail 40.

In certain embodiments, the surfaces of picket 14 may be painted prior to picket 14 being inserted through aperture 54 of rail plate 52 (e.g., at step 302) in order to ensure that the surfaces of picket 14 are fully coated with paint. To prevent scratching of the painted surfaces of picket 14, one or more protective sleeves may first be inserted over the inside edge aperture 54. For example, the protective sleeves may be Mylar sleeves that can be removed once picket 14 has passed through aperture 54 of rail plate 52.

At step 304, connection regions 60 may be created on each of the one or more pickets 14. In certain embodiments, a connection region 60 of a picket 14 may be a portion of picket 14 that has been crushed or otherwise deformed by having two opposing faces of picket 14 pushed together (e.g., faces 62*a* and 62*b* illustrated in FIG. 5C) resulting in widening of picket 14 in one d or more selected directions (e.g., as shown in the cross section illustrated in FIG. 5B) and a narrowing of picket 14 in one or more other directions (e.g., as shown in the longitudinal section illustrated in FIG. 5C). For example, a deformation component may apply a crushing force to opposing faces of picket 14, an example of which is described below with respect to FIGS. 9A-9C. In certain other embodiments, connection region 30 of picket 14 may be a portion of picket 14 to which material has been added, resulting in a widening of picket 14 (as shown in the cross sections illustrated in FIGS. 13A, 14A, 15A, and 16A).

At step 306, rail plate 50 may be positioned inside the channel formed by first surface 40, second surface 44, and third surface 46 by sliding rail 40 over rail plate 52. Rail plate 52 may have a rail plate lips 56 and 58 oriented such that they extend downward over upwardly extending lips 48 and 50 of rail 40.

As described above, at least a portion of connection region 60 of picket 14 may be located on a portion of picket 14 located between rail plate aperture 54 of rail plate 52 and the interior of channel 47 formed by first surface 42, second surface 44, and third surface 48 of rail 40. Furthermore, the increased width of connection region 60 may be substantially prevented from passing through rail plate aperture 54. In addition, rail plate 52 may be wider than the opening defined by first lip 48 and second lip 50 of rail 40. As a result, connection region 60 may form a connection (i.e., rail-picket connection 38) between rail 40 and picket 14, although picket 14 may not be physically joined (e.g., welded) to rail 40.

Rail-picket connection 38 may substantially prevent translational movement of picket 14 with respect to rail 40 for reasons described above with respect to FIGS. 5A-5D. Similarly, rail-picket connection 38 may substantially prevent angular movement of picket 14 with respect to rail 40 (other than angular movement along the longitudinal axis of rail 40) for reasons described above with respect to picket FIGS. 5A-5D.

Although the particular steps of the method 300 have been illustrated and primarily described as being performed in a particular order and in a particular manner, the present invention contemplates that the steps take place in any suitable order and be performed in any suitable manner. For example, rather than locating rail plate 52 in the channel formed by first surface 42, second surface 44, and third surface 48 of rail 40 by sliding rail 40 over rail plate 52, rail 40 may be deformed in order to widen of the opening defined by first lip 48 and second lip 50 such that such that rail plate 52 may pass between the opening defined by first lip 40 and second lip 50. Once rail plate 52 has been located in channel 47 formed by first surface 42, second surface 44, and third surface 48 of rail 40, rail 40 may be returned to its original form such that rail plate 52 may be substantially prevented from passing through the opening defined by first lip 48 and second lip 50.

Figure 8:
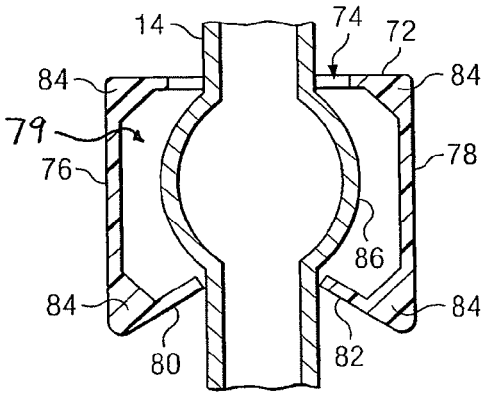
FIG. 8 illustrates a cross-sectional view of a third example rail-picket connection, according to certain embodiments of the present invention.

FIG. 8 illustrates a cross-sectional view of a third example rail-picket connection 68, according to certain embodiments of the present invention. In certain embodiments, rail-picket connection 68 may be used in place of one or more first rail-picket connections 16 in fence system section 10 illustrated in FIG. 1. More particularly, rail-picket connection 68 may correspond to an embodiment of rail-picket connection 16 (illustrated in FIGS. 2A-2D) in which the rail and/or the picket are constructed of plastic. In certain embodiments, rail-picket connection 68 includes both a plastic rail 70 and picket 14.

Plastic rail 70 of rail-picket connection 68 may have a first surface 72 having an aperture 74. Plastic rail 70 may also have a second surface 76 and third surface 78. First surface 72, second surface 76, and third surface 78 may be oriented such that they form a channel 79. Second surface 76 of plastic rail 70 may include a first lip 80 extending into channel 79 formed by first surface 72, second surface 76, and third surface 78. Similarly, third surface 76 of plastic rail 70 may include a second lip 82 extending into channel 79 formed by first surface 72, second surface 76, and third surface 78. Additionally, in order to compensate for the potentially weaker plastic material as compared to other materials (e.g., aluminum, steel, or brass), plastic rail 70 may also include on or more reinforcing fillets 84, if desired. For example, plastic rail 70 may include a reinforcing fillet 84 at the intersection of first surface 72 with second surface 76, at the intersection of first surface 72 with third surface 78, at the intersection of second surface 76 with first lip 80, and at the intersection of third surface 78 with second lip 82.

Aperture 74 may be one of a plurality of apertures in first surface 72 of plastic rail 70. Aperture 74 in first surface 78 may be round, rectangular, or any other suitable shape. For example, the shape of aperture 74 in first surface 72 may correspond to the cross-section shape of picket 14 (e.g., aperture 74 in first face 72 would be rectangular if picket 14 were constructed of a length of rectangular tubing).

Picket 14 of rail-picket connection 68 may be inserted through the opening defined by first lip 80 and second lip 82 and through aperture 74 of plastic rail 70. In certain embodiments, picket 14 includes a connection region 86. Connection region 86 of picket 14 may be portion of picket 14 that has been crushed. For example, connection region 86 may be a portion of picket 14 where two opposing surfaces of picket 14 have been pushed together (e.g., by application of pressure and/or heat to picket 14, as described in further detail below with respect to FIGS. 9A-9C), resulting in a widening of picket 14 in one cross-sectional direction and a narrowing of picket 14 in the other cross-sectional direction (illustrated in FIG. 2B).

At least a portion of connection region 86 of picket 14 may be located on a portion of picket 14 located between aperture 74 and the opening defined by first lip 80 and second lip 82. Furthermore, connection region 86 may be substantially prevented from passing through aperture 20 or between the opening defined by first lip 80 and second lip 82. As a result, connection region 86 may form a connection (rail-picket connection 68) between plastic rail 70 and picket 14, although picket 14 is not physically joined (e.g., welded) to rail 12.

Rail-picket connection 68 may substantially prevent translational movement of picket 14 with respect to plastic rail 70 for reasons analogous to those described above with respect to rail-picket connection 16 illustrated in FIGS. 2A-2D. Similarly, rail-picket-connection 68 may substantially prevent angular movement of picket 14 with respect to plastic rail 70 (other than angular movement along the longitudinal axis of plastic rail 70) for reasons analogous to those described above with respect to rail-picket connection 16 illustrated in FIGS. 2A-2D.

Although rail-picket connection 68 is illustrated and primarily described as corresponding to an embodiment of rail-picket connection 16 (as illustrated in FIGS. 2A-2D) in which the rail and/or the picket are constructed of plastic, the present invention contemplates that rail-picket connection 68 may correspond to an embodiment of rail-picket connection 38 (illustrated in FIGS. 5A-5D) in which the rail and/or the picket are constructed of plastic.

Figure 9A:
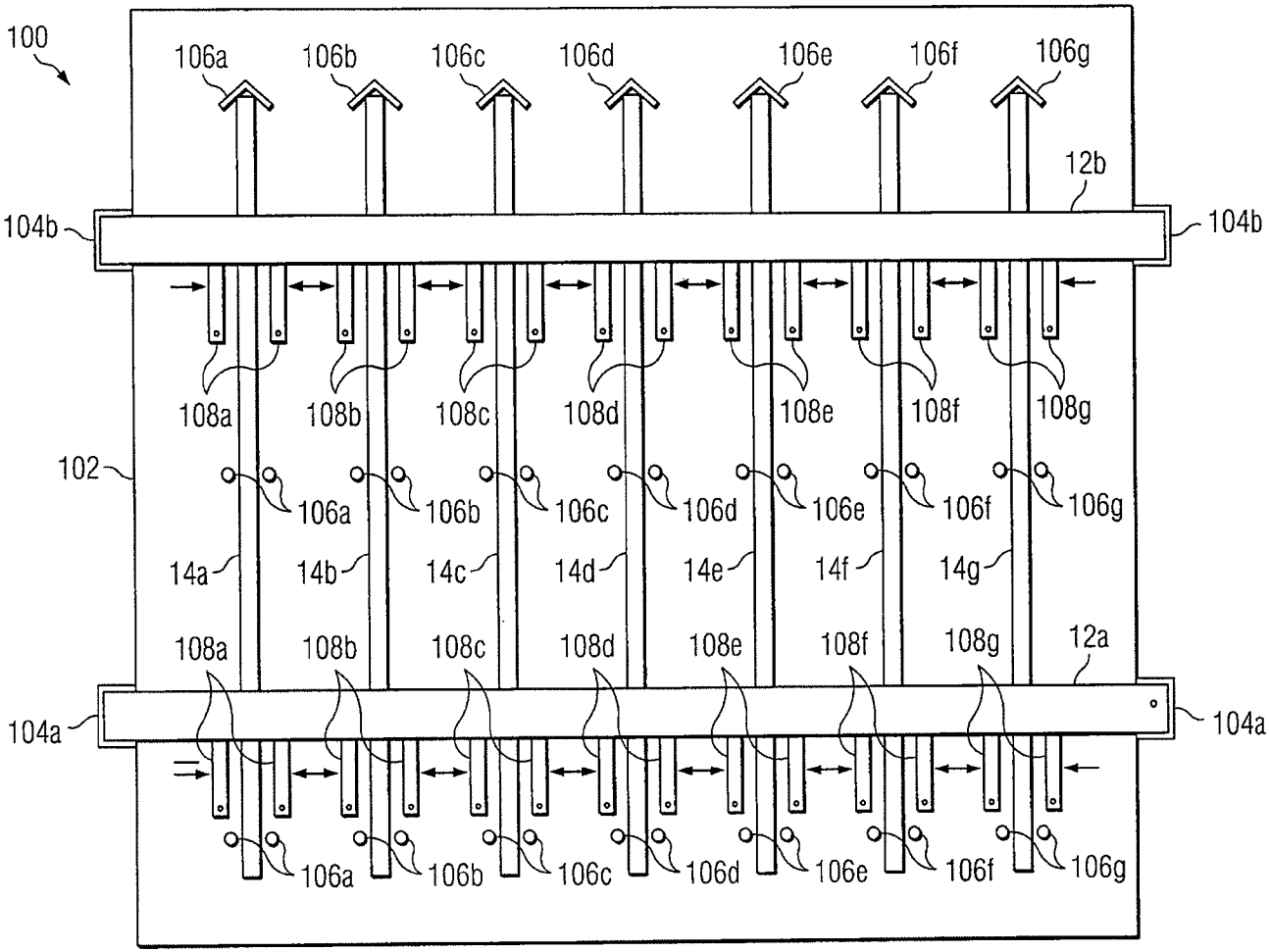
FIGS. 9A-9C illustrate an example assembly apparatus for assembling example fence system section having a number of first example rail-picket connections, according to certain embodiments of the present invention.
Figure 9B:
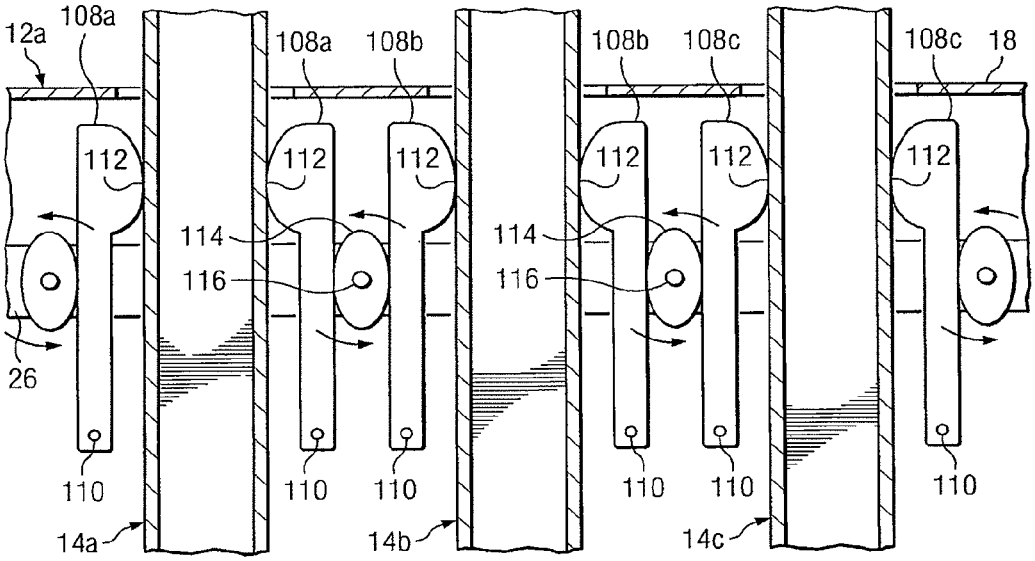
Figure 9C:
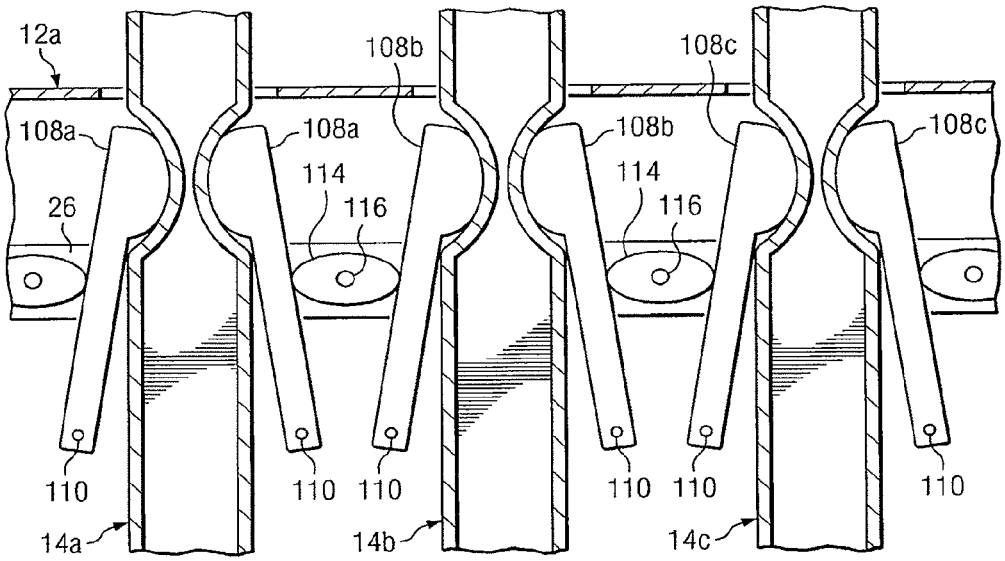

FIGS. 9A-9C illustrate an example assembly apparatus 100 assembling example fence system section 10 having a number of first example rail-picket connections 16, according to certain embodiments of the present invention. Assembly apparatus 100 may include a table 102 (i.e., such that the view shown in FIGS. 9A-9C is a top-view of the table) for holding a number of rails 12 and a number of pickets 14. Although a particular number of rails 12 and pickets 14 are illustrated and primarily described, the present invention contemplates assembly apparatus accommodating any suitable number of rails 12 and pickets 14, according to particular needs.

Rails 12 may be held in place on table 102 by one or more rail retention components 104. Furthermore, rails 12 may be held in place on table 102 by rail retention components 104 such that rails 12 are substantially parallel to one another. Pickets 14 may be held in place on table 102 by one of more picket retention components 106. Each picket 14 may be inserted through an opening defined by a first lip and second lip of each rail 12 and through a corresponding aperture 20 in a first face of each rail 12. Furthermore, pickets 14 may be held in place on table 102 by picket retention components 106 such that pickets 14 are substantially parallel to one another.

Assembly apparatus 100 may include a number of deformation components 108. A pair of deformation components 108 may correspond to a picket 14 at the locating where picket 14 passes through a rail 12, with one deformation component 108 of each pair of deformation components 108 located on either side of the corresponding picket 14. Furthermore, each deformation component 108 may be oriented to be inserted through the opening defined by first and second lips 26 and 28 of a rail 12 into channel 25 formed by the first, second, and third surfaces 18, 22, and 24 of rail 12. For example, as illustrated in the –longitudinal section views illustrated in FIGS. 9B-9C, deformation components 108*a* may be located on opposite sides of picket 14*a*. Furthermore, deformation components 108*a* may be inserted through the opening defined by first lip 26 and second lip 28 of rail 12.

Deformation components 108 may be connected to table 102 at deformation component attachment points 110. Deformation component attachment points 110 may include pins inserted through deformation components 108 such that deformation components 108 can rotate about deformation component attachment points 110.

Deformation components 108 may have deformation surfaces 112. Deformation surfaces 112 may be convex surfaces of deformation components 108 oriented to face a surface of pickets 14 to which the deformation component 108 corresponds, the deformation surfaces 112 located substantially in channel 57 formed by the first, second, and third surfaces 18, 22, and 24 of rail 12. For example, deformation surfaces 112*a* of deformation components 108*a* corresponding to picket 14*a* may be located on a portion of deformation components 108*a* located in channel 57 formed by first surface 18, second surface 22, and third surface 24 of rail 12 on either side of a corresponding picket 14*a* such that first deformation surfaces 112*a* face surface of picket 14*a*, picket 14*a* inserted through the opening defined by the first lip 26 and second lip 28 of the rail 12 and aperture 20 of the first surface 18 of the rail 12.

Assembly apparatus 100 may also include a number of cam components 114. Each cam component 114 may be attached to assembly apparatus 100 at cam component attachment points 116. Cam component attachment points 116 may include pins inserted through cam components 112 such that cam components 112 can rotate about deformation cam attachment points 116. Furthermore, each cam component 114 may be connected to a power source (e.g., an electric motor) operable to supply a rotational force to the cam component 114. As a rotational force is applied a cam component 114, cam component 114 may rotate about cam component attachment point 116 such that a force is supplied to deformation components 108 located on either side of the cam component 114 ("crushing force"). Furthermore, in certain embodiments, deformation surfaces 112 of deformation components 108 may be heated, such that a crushing force and heat may be applied (possibly simultaneously) to picket 14.

A rotational force may be simultaneously applied to each cam component 114 of assembly apparatus 100 such that a crushing force is supplied to each deformation component 108 of assembly apparatus 100. As a result of the crushing force, each deformation component 108 will rotate about attachment point 110 such that deformation surfaces 112 will contact a corresponding surface of picket 14 (as illustrated in FIG. 9C), transferring the crushing force to picket 14 via deformation face 112. As a result of the crushing force supplied by cam components 114, a pair of deformation components 108 corresponding to a particular picket 14 may crush a portion of picket 14 (creating a connection region 30 on picket 14) by pushing two opposing surfaces of picket 14 (e.g., surfaces 32*a* and 32*b* illustrated in FIG. 2C), resulting in a widening of picket 14 in the cross-sectional direction (illustrated in FIG. 2C) and a narrowing of picket 14 in the other longitudinal-section direction (illustrated in FIGS. 2C and 9C). In certain embodiments, deformation surfaces 112 of deformation components 108 may be heated such that a crushing force and heat may be applied to a picket 14. Furthermore, at least a portion of the resulting connection region 30 of picket 14 may be located on a portion of picket 14 located between aperture 20 and the opening defined by first lip 26 and second lip 28.

Although cam component 114 has been illustrated and primarily described as supply a crushing force to each deformation component 108, the present invention contemplates that any suitable method may be used to supply a crushing force to each deformation component 108. For example, a hydraulic or pneumatic cylinder may be inserted in place of each cam component 114. Furthermore, although assembly apparatus 100 has been illustrated and primarily described as assembling a fence system section 10 having one or more first rail-picket connections 16, the present invention contemplates a similar apparatus may be used for assembling a fence system section 10 having one or more second rail-picket connections 38 or one or more third rail-picket connections 68.

Figures 10A, 10B:
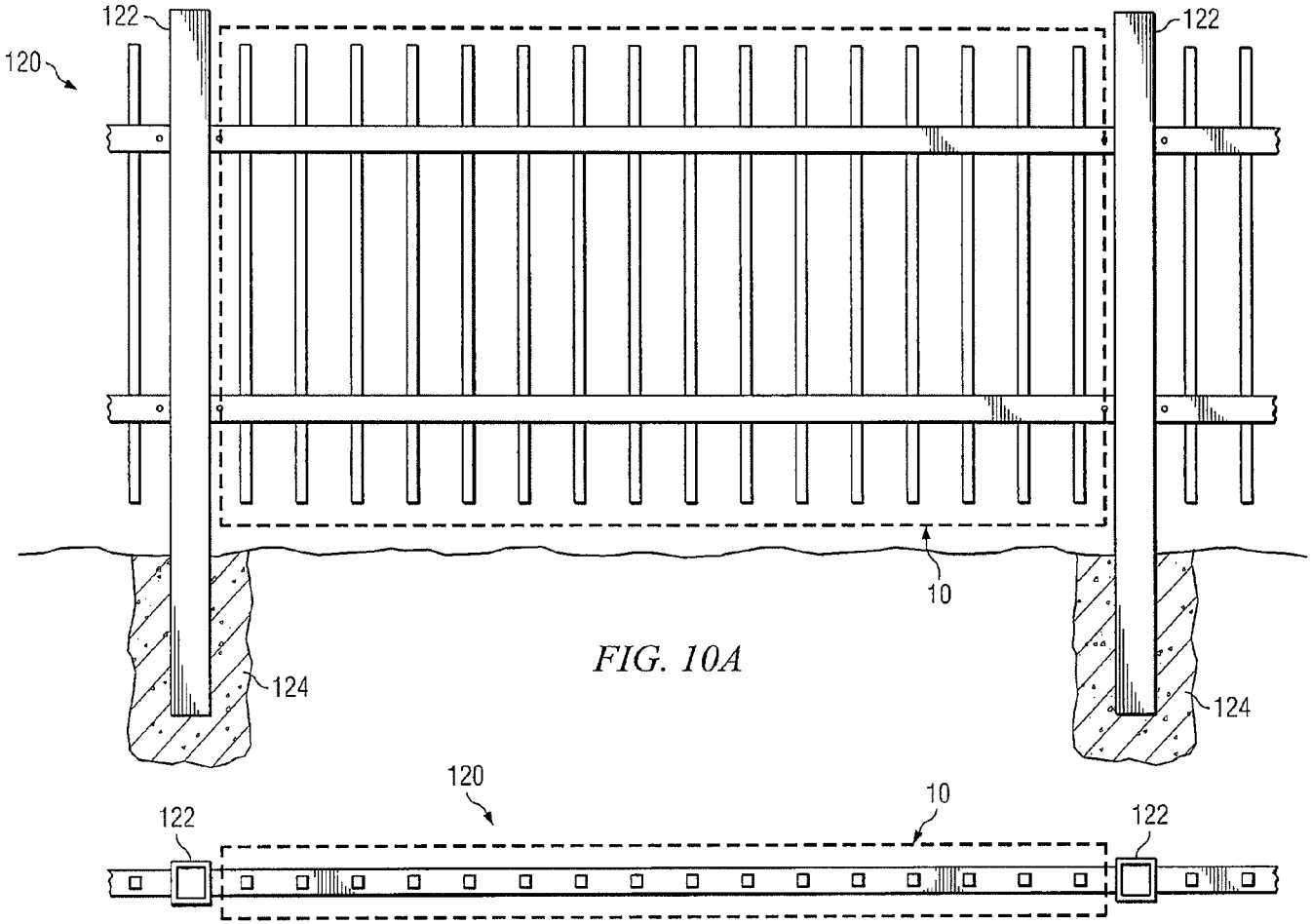
FIGS. 10A-10C illustrate an example fence system having multiple example fence system sections illustrated in FIG. 1, according to certain embodiments of the present invention.
Figure 10C:
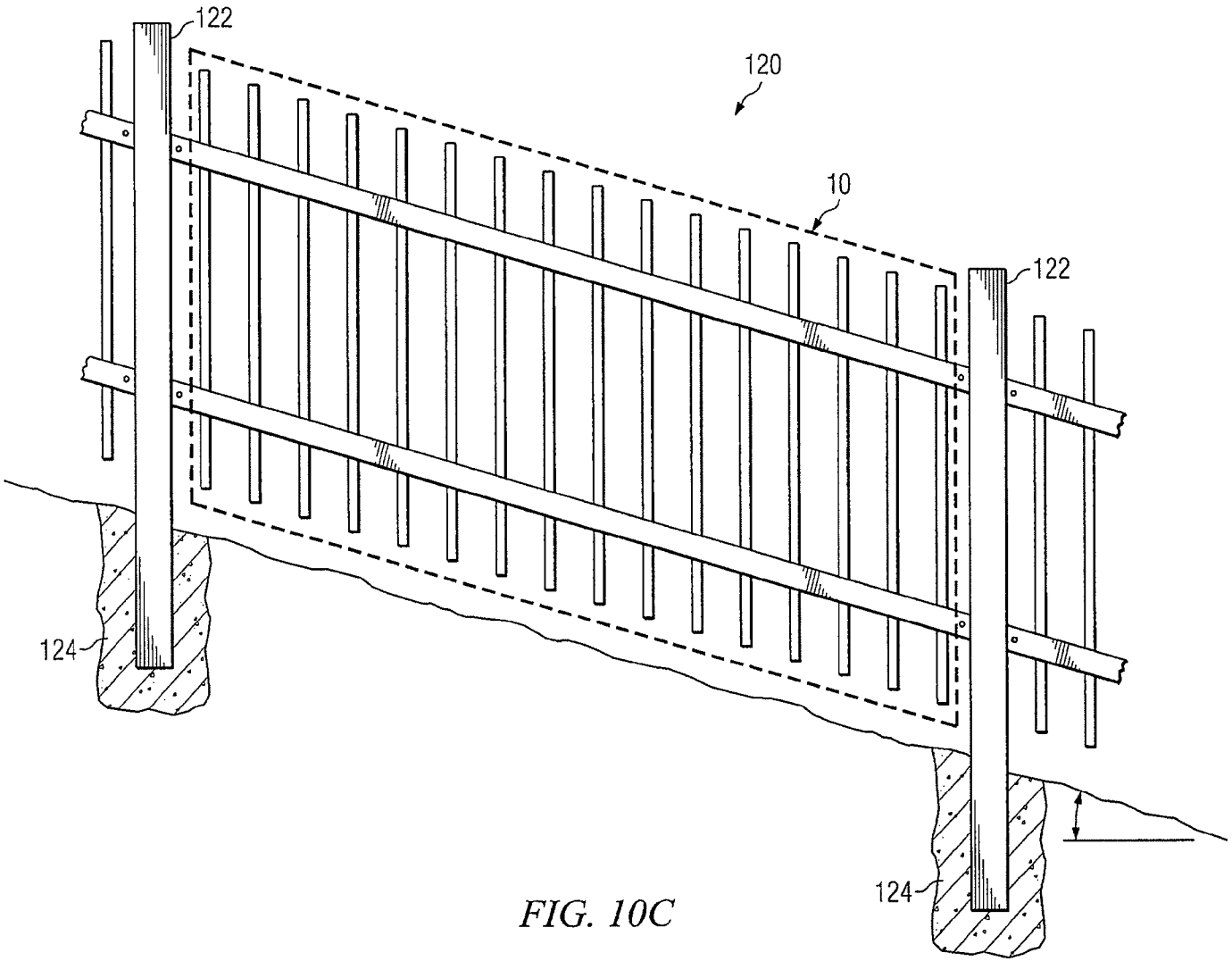

FIGS. 10A-10C illustrate an example fence system 120 having multiple example fence system sections 10 illustrated in FIG. 1, according to certain embodiments of the present invention. Fence system 120 may include two or more posts 122. Posts 122 may be constructed from any suitable combination of aluminum, iron, stainless steel, galvanized steel, brass, plastic, wood or any other suitable material. Furthermore, posts 122 may be constructed from tubing material of any desired cross section (e.g., rectangular, round, elliptical), solid material of any desired cross section (e.g., rectangular, round, elliptical), angle iron, I-beam, or any other suitable material. In certain embodiments, posts 122 may be anchored in the ground (e.g., using concrete 124) such that posts 122 are substantially vertical regardless of ground slope (as illustrated in FIGS. 10A and 10C). For example, posts 122 may be set substantially vertically into cement, a concrete slab, or in any other suitable manner. Posts 122 may be any suitable length (e.g., four, eight, or twenty feet). Furthermore, in this example, the distance between two of the two or more substantially vertical posts 122 may correspond to the length of rails 12 of fence system section 10 such that fence system section 10 may span the distance between two posts 122.

In certain embodiments, a fence system section 10 may be located between two posts 12, as illustrated in FIG. 10B. Rails 12 of fence system section 10 may be welded, bolted, screwed, riveted, or otherwise attached to posts 12 in any suitable manner. Furthermore, as a result of attaching rails 12 to posts 122, the plurality of pickets 14 of a fence system section 10 may be oriented such that pickets 14 are substantially parallel with the two post 120 between which fence system section 10 is located regardless or ground slope (e.g., as illustrated in FIGS. 10A and 10 C), within a desired range. The desired range may be determined by a variety of factors. As an example, the size and shape of apertures 20 of rail 12 may affect the limits on the angular movement of pickets 14.

Although fence system 120 is illustrated an primarily described as having fence system sections 10 with rails 12 (i.e., first rail-picket connections 16), the present invention contemplates that fence system 120 may include a fence system section 10 any suitable combination of different rails (e.g., rail 12 of rail-picket connection 16, rail 40 of rail-picket connection 30, and/or rail 70 of rail-picket connection 68).

FIGS. 11A-11E illustrate another example fence system 130 having multiple example fence system sections 10 illustrated in FIG. 1, according to certain embodiments of the present invention. Fence system 120 may include two or more posts 122. In certain embodiments, posts 122 may be anchored in the ground (e.g., using concrete 124) such that posts 122 are substantially vertical regardless of ground slope (as illustrated in FIGS. 10A and 10C). Furthermore, the distance between two of the two or more substantially vertical posts 122 may be of any suitable distance.

In certain embodiments, one or more fence system sections 10 may be attached to a side of two or more posts 12, as illustrated in FIG. 10C. In addition, two rails (of two separate fence system sections 10 may be attached to one another (e.g., welded) such that the distance between two posts 122 of fence system 130 need not correspond to the length of rails 12 of fence system section 10. A rail 12 of a fence system section 10 may be attached to a post 122 using attachment system 128 (illustrated in FIGS. 11D-11E, described in further detail below). Furthermore, as a result of attaching rails 12 to posts 122, the plurality of pickets 14 of one or more fence system sections 10 of fence system 130 may be oriented such that pickets 14 are substantially parallel to the two or more posts 122 of fence system 130 regardless or ground slope (as illustrated in FIGS. 10A and 10), within a desired range.

Figures 11A, 11B:
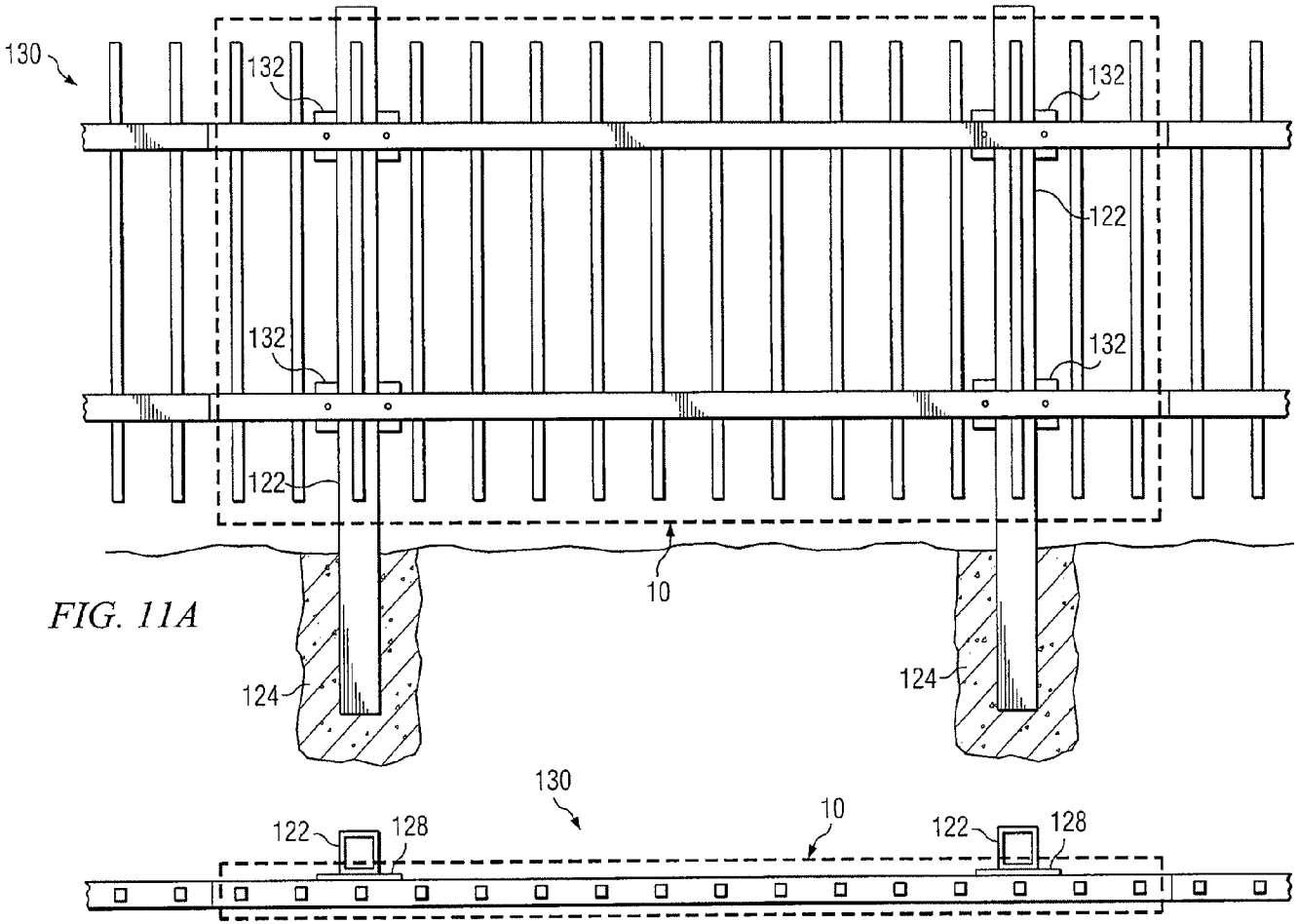
FIGS. 11A-11E illustrate another example fence system having multiple example fence system sections illustrated in FIG. 1, according to certain embodiments of the present invention.
Figure 11C:
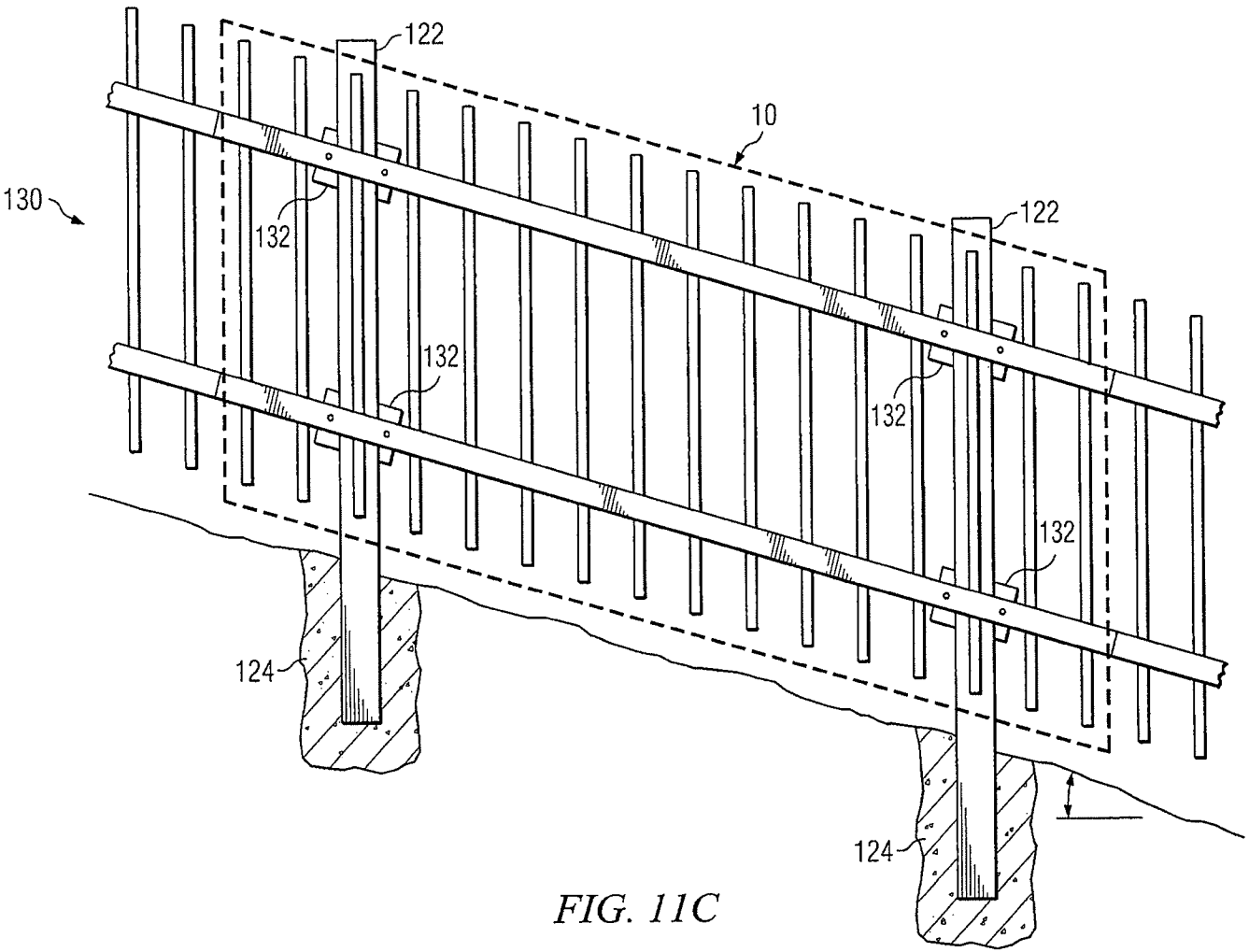
Figure 11D:
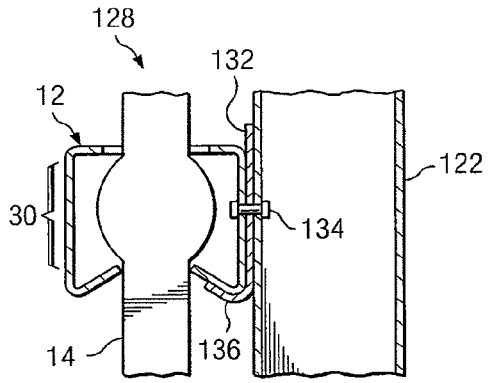
Figure 11E:
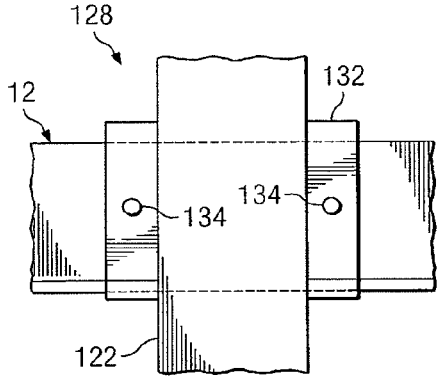

Attachment system 128 of fence system 130 may include an attachment bracket 132 that is welded, bolted, screwed, riveted, or otherwise attached to a post 122 in any suitable manner. Attachment bracket 132 may have a lip 136 that corresponds generally to first lip 26 or second lip 28 of rail 12 such that rail 12 may be hung on attachment bracket 132. Attachment system 128 may further include one or more connectors 134 connecting rail 12 to attachment bracket 134. Connectors 134 may include screws, bolts, rivets, or any other suitable hardware for attaching attachment bracket 134 and rail 12. For example, connectors 134 may be self-taping screws. Furthermore, attachment bracket 132 may be wider than post 122 (as illustrated in FIG. 11E) such that a connector 134 may be may be inserted through attachment bracket 132 into rail 12 on either side of post 122 (as illustrated in FIG. 11E).

Although fence system 130 is illustrated an primarily described as having fence system sections 10 with rails 12 (i.e., first rail-picket connections 16), the present invention contemplates that fence system 120 may include a fence system section 10 any suitable combination of different rails (e.g., rail 12 of rail-picket connection 16, rail 40 of rail-picket connection 30, and/or rail 70 of rail-picket connection 68).

Figure 12A:
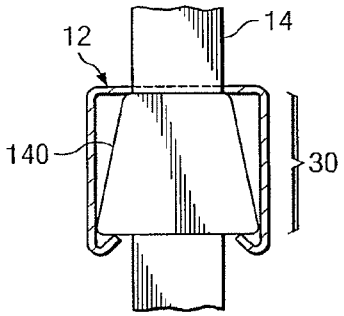
FIGS. 12A-12B illustrate an example alternative first connection region of the first example rail-picket connection, according to certain embodiments of the present invention.
Figure 12B:
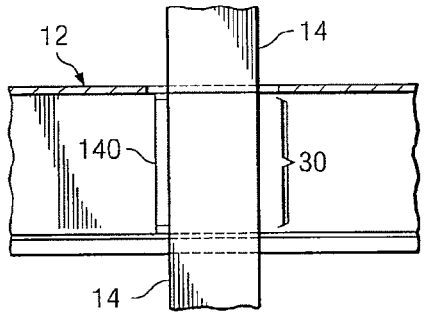

FIGS. 12A-12B illustrate an example alternative connection region 30 of first example rail-picket connection 16, according to certain embodiments of the present invention. In the illustrated embodiment, connection region 30 is a region of picket 14 to which material has been added (i.e., connection component 140). Connection component 140 may be steel, galvanized steel, aluminum, brass, plastic, or any other suitable material. For example, connection component 140 may be a trapezoid-shaped galvanized steel plate.

The thickness of connection component 140 (illustrated in FIG. 12B) may be less that the width of the opening defined by the first lip 26 and second lip 28 of rail 12 such that connection component 140 may pass through the opening defined by first lip 26 and second lip 28 of rail 12. Connection component 140 may be welded, bolted, screwed, riveted, or otherwise attached to picket 14 in any suitable manner, connection component 140 being attached on a portion of picket 14 located between aperture 20 and the opening defined by first lip 26 and second lip 28 (as illustrated in FIG. 12A).

Connection component 140 may be wider than aperture 20 in first surface 18 and the opening defined by first lip 26 and second lip 28. As a result, connection region 30 may be substantially prevented from passing through aperture 20 or between the opening defined by first lip 26 and second lip 28 such that connection region 30 may form a connection (i.e., rail-picket connection 16) between rail 12 and picket 14, although picket 14 may not be physically connected (e.g., welded) to rail 12. Furthermore, the resulting rail-picket connection 16 may substantially prevent translational movement of picket 14 with respect to plastic rail 12 for reasons described above with respect to FIGS. 2A-2C. Similarly, rail-picket connection 16 may substantially prevent angular movement of picket 14 with respect to rail 12 (other than angular movement 34 along the longitudinal axis of rail 12) for reasons described above with respect to FIGS. 2A-2C.

Figure 13A:
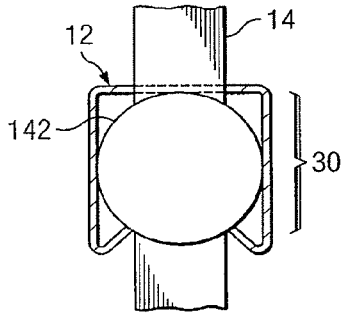
FIGS. 13A-13B illustrate another example alternative first connection region of the first example rail-picket connection, according to certain embodiments of the present invention.
Figure 13B:
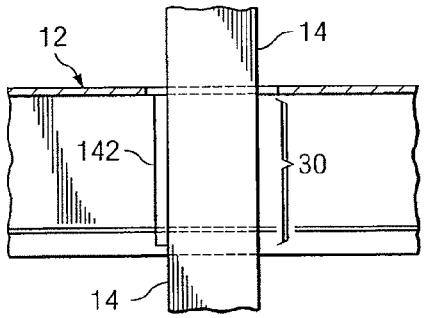

FIGS. 13A-13B illustrate another example alternative connection region 30 of first example rail-picket connection 16, according to certain embodiments of the present invention. In the illustrated embodiment, connection region 30 is a region of picket 14 to which material has been added (i.e., connection component 144). Connection component 142 may be steel, galvanized steel, aluminum, brass, plastic, or any other suitable material. For example, connection component 142 may be a disc-shaped galvanized steel plate.

The thickness of connection component 142 (illustrated in FIG. 13B) may be less that the width of the opening defined by the first lip 26 and second lip 28 of rail 12 such that connection component 142 may pass through the opening defined by first lip 26 and second lip 28 of rail 12. Connection component 142 may be welded, bolted, screwed, riveted, or otherwise attached to picket 14 in any suitable manner, connection component 142 being attached on a portion of picket 14 located between aperture 20 and the opening defined by first lip 26 and second lip 28 (as illustrated in FIG. 13A).

Connection component 142 may be wider than aperture 20 in first surface 18 and the opening defined by first lip 26 and second lip 28. As a result, connection region 30 may be substantially prevented from passing through aperture 20 or between the opening defined by first lip 26 and second lip 28 such that connection region 30 may form a connection (i.e., rail-picket connection 16) between rail 12 and picket 14, although picket 14 may not be physically connected (e.g., welded) to rail 12. Furthermore, the resulting rail-picket connection 16 may substantially prevent translational movement of picket 14 with respect to plastic rail 12 for reasons described above with respect to FIGS. 2A-2C. Similarly, rail-picket connection 16 may substantially prevent angular movement of picket 14 with respect to rail 12 (other than angular movement 34 along the longitudinal axis of rail 12) for reasons described above with respect to FIGS. 2A-2C.

Figure 14A:
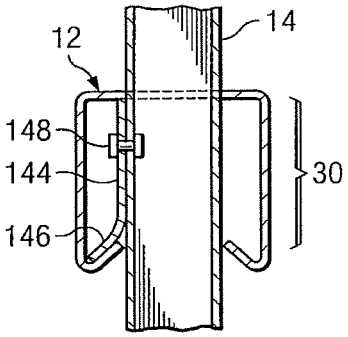
FIGS. 14A-14B illustrate an example alternative first connection region of the first example rail-picket connection, according to certain embodiments of the present invention.
Figure 14B:
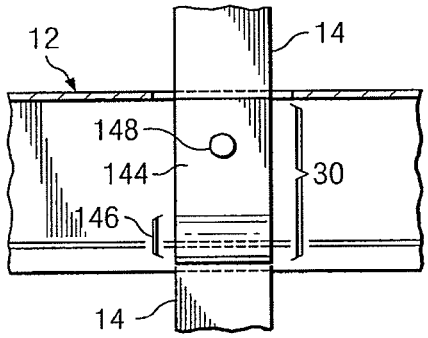

FIGS. 14A-14B illustrate an example alternative connection region 30 of rail picket connection 16, according to certain embodiments of the present invention. In the illustrated embodiment, connection region 30 is a region of picket 14 to which material has been added (i.e., connection component 144). Connection component 144 may be steel, galvanized steel, aluminum, brass, plastic, or any other suitable material. For example, connection component 144 may be galvanized steel plate having a lip 146.

Connection component 144 may be welded, bolted, screwed, riveted, or otherwise attached to picket 14 in any suitable manner. For example, connection component 144 may be attached to picket 14 with rivet 148. Furthermore, lip 146 of connection component 144 may substantially prevent picket 14 from passing through aperture 20 or between the opening defined by first lip 26 and second lip 28 such that connection region 30 may form a connection (i.e., rail-picket connection 16) between rail 12 and picket 14, although picket 14 may not be physically connected (e.g., welded) to rail 12. Furthermore, the resulting rail-picket connection 16 may substantially prevent translational movement of picket 14 with respect to plastic rail 12 for reasons described above with respect to FIGS. 2A-2C. Similarly, rail-picket connection 16 may substantially prevent angular movement of picket 14 with respect to rail 12 (other than angular movement 34 along the longitudinal axis of rail 12) for reasons described above with respect to FIGS. 2A-2C.

Figure 15A:
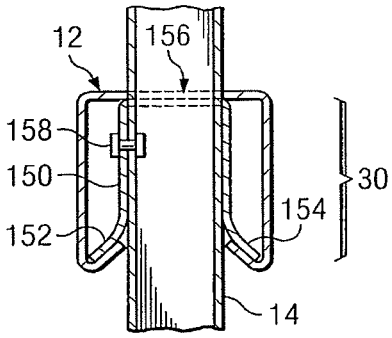
FIGS. 15A-15B illustrate an example alternative first connection region of the first example rail-picket connection, according to certain embodiments of the present invention.
Figure 15B:
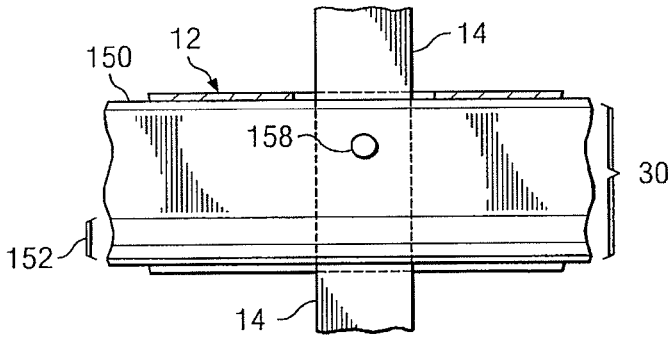

FIGS. 15A-15B illustrate an example alternative connection region 30 of first example rail-picket connection 16, according to certain embodiments of the present invention. In the illustrated embodiment, connection region 30 is a region of picket 14 to which material has been added (i.e., connection component 150). Connection component 150 may be steel, galvanized steel, aluminum, brass, plastic, or any other suitable material. For example, connection component 150 may be galvanized steel channel having outwardly extending lips 152 and 154. Furthermore, connection component 150 may have an aperture 154 through which picket 14 may be inserted.

Connection component 150 may be welded, bolted, screwed, riveted, or otherwise attached to picket 14 in any suitable manner. For example, connection component 150 may be attached to picket 14 with rivet 158. Furthermore, lips 152 and 154 of connection component 150 may substantially prevent picket 14 from passing through aperture 20 or between the opening defined by first lip 26 and second lip 28 such that connection region 30 may form a connection (i.e., rail-picket connection 16) between rail 12 and picket 14, although picket 14 may not be physically connected (e.g., welded) to rail 12. Furthermore, the resulting rail-picket connection 16 may substantially prevent translational movement of picket 14 with respect to plastic rail 12 for reasons described above with respect to FIGS. 2A-2C. Similarly, rail-picket connection 16 may substantially prevent angular movement of picket 14 with respect to rail 12 (other than angular movement 34 along the longitudinal axis of rail 12) for reasons described above with respect to FIGS. 2A-2C.

Although example alternative connection regions 30 have been illustrated and primarily described in FIGS. 12A-12B, 13A-13B, 14A-14B, and 15A-15B, the present invention contemplates similar alternative connection regions 60 of rail-picket connection 38 (illustrated in FIGS. 5A-5D) and a similar alternative connection regions 30 of third rail-picket connections 68 (illustrated in FIG. 8).

Particular embodiments of the present invention may provide one or more technical advantages. One technique for installing a picket-style fence is to construct and install the fence on site by setting a number of posts, spanning the distance between the posts by attaching two or more rails, and individually installing a number or pickets across the two or more rails. Installing the fencing on-site in this manner may be time consuming and, as a result, quite costly. An alternative to constructing and installing the fencing on-site is to manufacture fence sections including two or more rails and a number of pickets. Each fence section can then be installed between or across two posts on site. Manufacturing the fence in sections may reduce the time and effort required to install the fence and, as a result, reduce cost.

Because fencing is often installed on sloping ground, it is beneficial to manufacture fencing sections that are "rackable," meaning that the pickets of the fence section remain parallel to the posts between which the two or more rails are installed. Often, manufacturing fence system sections that are rackable increases the complexity as well as the cost of the fence system section. Certain embodiments of the present invention provide a fence system section that is rackable, while minimizing the complexity and cost associated with manufacturing the fence system section.

Although the present invention has been described with several embodiments, diverse changes, substitutions, variations, alterations, and modifications may be suggested to one skilled in the art, and it is intended that the invention encompass all such changes, substitutions, variations, alterations, and modifications as fall within the spirit and scope of the appended claims.

What is claimed is:

1. A method, comprising:

setting a first fence post in a first foundation at a first location;

setting a second fence post in a second foundation at a second location; and coupling a first rail of a fence section to at least one of the first post and the second post, the fence section comprising:

the first rail, the first rail comprising:

a first surface extending generally parallel to a longitudinal axis of the first rail and having one or more apertures; and a second surface and a third surface each generally to the longitudinal axis of the first rail and opposing one another such that the first, second, and third surfaces of the first rail form a channel, the second surface of the first rail having a first lip and the third surface of the first rail having a second lip, the first lip and the second lips extending into the channel formed by the first, second, and third surfaces of the first rail; and one or more pickets each inserted through a corresponding one of the one or more apertures of the first surface of the first rail, each of the one or more pickets having a first connection region located substantially in the channel formed by the first, second, and third surfaces of the first rail, at least a portion of each of first and second opposing surfaces of each picket being deformed toward each other such that at least a portion of the first connection region is narrower, along a first axis extending generally parallel to the longitudinal axis of the first rail, than an adjacent portion of the picket and is wider, along a second axis substantially perpendicular to the longitudinal axis, than the adjacent portion of the picket, the at least a portion of the first connection region being adapted to substantially prevent the first connection region from passing through the corresponding aperture in the first surface of the first rail or between the opening defined by the first and second lips of the first rail.

2. The method of claim 1, wherein:

the fence section further comprises a second rail, the second rail comprising:

a first surface extending generally parallel to the longitudinal axis of the second rail and having one or more apertures; and a second surface and a third surface each extending generally parallel to the longitudinal axis of the second rail and opposing one another such that the first, second, and third surfaces of the second rail form a channel, the second surface of the second rail having a first lip and the third surface of the second rail having a second lip, the first lip and the second lip extending into the channel formed by the first, second, and third surfaces of the second rail;

the method further comprises coupling the second rail of the fence section to at least one of the first post and the second post; and the one or more pickets each inserted through a corresponding one of the one or more apertures of the first surface of the first rail are inserted through a corresponding one of the one or more apertures of the first surface of the second rail, each of the one or more pickets having a second connection region located substantially in the channel formed by the first, second, and third surfaces of the second rail such that the second connection region is substantially prevented from passing through the corresponding aperture in the first surface of the second rail or between the opening defined by the first and second lips of the second rail.

3. The method of claim 1, further comprising inserting a first picket of the one or more pickets through a corresponding one of the one or more apertures of the first surface of the first rail, wherein inserting the first picket comprises:

inserting the first picket through a protective sleeve in the corresponding one of the one or more apertures, the protective sleeve designed to prevent scratching of paint on one or more surfaces of the first picket; and removing the sleeve subsequent to inserting the first picket through the corresponding one of the one or more apertures.

4. The method of claim 1, wherein:

the first rail of the fence section is coupled to both the first post and the second post such that the fence section spans the space between the first post and the second post; and the first rail is located in the same plane as the first post an the second post.

5. The method of claim 1, wherein:

the first rail of the fence section is coupled to both the first post and the second post such that the fence section spans the space between the first post and the second post; and the first rail is located in a different plane from the first post an the second post.

6. The method of claim 5, further comprising coupling a first attachment bracket to the first post and a second attachment bracket to the second post, wherein the first rail of the fence section is coupled to the first post and the second post via the first attachment bracket and the second attachment bracket.

7. The method of claim 6, wherein the first attachment bracket and the second attachment bracket each comprise a lip that corresponds to one of the first lip and the second lip of the first rail.

8. The method of claim 1, further comprising:

coupling the first rail of the fence section to a first rail of an adjacent fence section to form a combined fence section;

coupling the first rail of the adjacent fence section to at least one of the first post and the second post such that the combined fence section spans the space between the first post and the second post.

9. The method of claim 8, wherein the first rail and the second rail are each located in a different plane from the first post and the second post.

10. The method of claim 9, further comprising coupling a first attachment bracket to the first post and a second attachment bracket to the second post, wherein the first rail of the fence section is coupled to the first post via the first attachment bracket and the first rail of the adjacent fence section is coupled to the second post via the second attachment bracket.

11. The method of claim 1, wherein:

the first fence post is set in the first foundation such that it is substantially vertical;

the second fence post is set in the second foundation such that it is substantially vertical; and the first rail of the fence section is coupled to at least one of the first post and the second post such that the first rail is substantially parallel to at least a portion of a section of ground located between the first location and the second location.

12. The method of claim 1, wherein the first rail of the fence section is coupled to at least one of the first post and the second post such that the one or more pickets are substantially parallel to at least one of the first post and the second post.

* * * * *